US012741797B2

(12) United States Patent
Burattini

(10) Patent No.: US 12,741,797 B2
(45) Date of Patent: Sep. 22, 2026

(54) SEALED SINGLE-DOSE BREAK-OPEN PACKAGE, DEVICE AND METHOD FOR MAKING

(71) Applicant: V-SHAPES S.R.L., Calderara di Reno (IT)

(72) Inventor: Christian Burattini, San Giovanni in Persiceto (IT)

(73) Assignee: V-SHAPES S.R.L., Calderara di Reno (IT)

( * ) Notice: Subject to any disclaimer, the term of this patent is extended or adjusted under 35 U.S.C. 154(b) by 37 days.

(21) Appl. No.: 18/800,699

(22) Filed: Aug. 12, 2024

(65) Prior Publication Data

US 2024/0409292 A1 Dec. 12, 2024

Related U.S. Application Data

(62) Division of application No. 17/617,145, filed as application No. PCT/IT2020/050143 on Jun. 9, 2020, now Pat. No. 12,151,864.

(30) Foreign Application Priority Data

Jun. 14, 2019 (IT) ..... 102019000009036

(51) Int. Cl.
*B65D 75/58* (2006.01)
*B65B 9/04* (2006.01)
(Continued)

(52) U.S. Cl.
CPC ..... *B65D 75/585* (2013.01); *B65B 9/042* (2013.01); *B65B 61/06* (2013.01); *B65D 75/366* (2013.01)

(58) Field of Classification Search
CPC .... B65D 75/585; B65D 75/366; B65B 9/042; B65B 61/06
See application file for complete search history.

(56) References Cited

U.S. PATENT DOCUMENTS 3,986,640 A * 10/1976 Redmond ..... B65D 75/585 222/541.6
4,430,013 A * 2/1984 Kaufman ..... A61M 35/003 401/133

(Continued)

FOREIGN PATENT DOCUMENTS

EP 2628691 A1 8/2013
EP 2944579 A2 11/2015

(Continued)

OTHER PUBLICATIONS

Japanese Office Action dated Jun. 3, 2024 from counterpart Japanese Patent App No. 2021-573948.

(Continued)

*Primary Examiner* — Lucas E. A. Palmer
(74) *Attorney, Agent, or Firm* — SHUTTLEWORTH & INGERSOLL, PLC; Timothy J. Klima

(57) ABSTRACT

A sealed single-dose break-open package including a first sheet of semirigid plastic material; a second sheet of flexible plastic material superimposed on and sealed to the first sheet to define a sealed pocket containing a dose of a product; wherein the first sheet of semirigid plastic material includes at least one substantially straight first incision positioned at a first edge of the first sheet, and at least one shaped incision positioned in a central portion of the first sheet, laterally and at a distance from the straight first incision.

5 Claims, 22 Drawing Sheets

(51) Int. Cl.
*B65B 61/06* (2006.01)
*B65D 75/36* (2006.01)

(56) References Cited

U.S. PATENT DOCUMENTS

| | | | | |
|---|---|---|---|---|
| 4,493,574 | A * | 1/1985 | Redmond | B65D 75/585 222/541.6 |
| 4,724,982 | A * | 2/1988 | Redmond | B65D 75/367 222/541.6 |
| 5,316,400 | A * | 5/1994 | Hoyt | B65D 75/323 401/196 |
| 5,395,031 | A * | 3/1995 | Redmond | B65D 75/585 222/541.6 |
| 7,121,409 | B1 * | 10/2006 | Hamilton | B65D 75/585 222/541.6 |
| 7,552,823 | B2 * | 6/2009 | Schuehrer | A61M 35/006 206/581 |
| 10,086,988 | B2 * | 10/2018 | Grobman | B65D 77/08 |
| 11,548,710 | B2 * | 1/2023 | Tramontana | B65D 83/771 |
| 2003/0089625 | A1 * | 5/2003 | Moodie | B65D 75/585 383/207 |
| 2004/0000563 | A1 * | 1/2004 | Rendle | B65D 75/585 222/107 |
| 2007/0289891 | A1 * | 12/2007 | Davies | B65D 75/585 206/484 |
| 2014/0231296 | A1 * | 8/2014 | Reggio | B65D 75/585 206/484 |
| 2015/0307260 | A1 * | 10/2015 | Reggio | B65D 83/0445 206/531 |
| 2016/0375233 | A1 * | 12/2016 | Tidwell | B65D 75/585 604/310 |
| 2017/0043925 | A1 | 2/2017 | Burattini | |
| 2017/0320649 | A1 * | 11/2017 | Hashimoto | B32B 23/08 |
| 2018/0002044 | A1 * | 1/2018 | Rutter | B65D 75/30 |
| 2020/0398516 | A1 * | 12/2020 | Amato | B26D 5/00 |
| 2022/0024665 | A1 * | 1/2022 | Gustavsson | B65D 75/585 |
| 2022/0234804 | A1 * | 7/2022 | Burattini | B65B 61/06 |

FOREIGN PATENT DOCUMENTS

| | | | | |
|---|---|---|---|---|
| JP | 2014533222 | A | 12/2014 | |
| SU | 1336945 | A3 | 9/1987 | |
| WO | 2007145535 | A2 | 12/2007 | |
| WO | 2008038074 | A2 | 4/2008 | |
| WO | WO-2009040629 | A2 * | 4/2009 | B31B 70/25 |
| WO | 2013054169 | A1 | 4/2013 | |
| WO | 2014141728 | A1 | 9/2014 | |
| WO | WO-2015166453 | A1 * | 11/2015 | B65D 75/28 |
| WO | WO-2019138434 | A1 * | 7/2019 | B65B 61/02 |
| WO | WO-2019138435 | A1 * | 7/2019 | B65D 75/5855 |
| WO | WO-2022059042 | A1 * | 3/2022 | B65D 75/585 |

OTHER PUBLICATIONS

Columbian Office Action dated Jan. 23, 2024 from counterpart Columbian Patent App No. NC2021/0017023.

Search Report dated Jun. 9, 2020 from Brazilian App No. BR112021024985-0.

Office Action dated Sep. 19, 2022 from Chinese App No. 202080043602.9.

Second Office Action dated May 7, 2023 from Chinese App No. 202080043602.9.

Final Rejection dated Nov. 14, 2023 from Chinese App No. 202080043602.9.

Office Action dated Oct. 11, 2023 from Russian App No. 2021137506/11.

International Search Report dated Oct. 8, 2020 from counterpart PCT App No. PCT/IT2020/050143.

* cited by examiner

SEALED SINGLE-DOSE BREAK-OPEN PACKAGE, DEVICE AND METHOD FOR MAKING

This application is a divisional of U.S. patent application Ser. No. 17/617,145 filed Dec. 7, 2021, which is a National Phase of International Application PCT/IT2020/0501430 filed Jun. 9, 2020 which designated the U.S. and claims priority to Italian Application No. 102019000009036 filed Jun. 14, 2019. All applications are incorporated by reference herein.

FIELD OF TECHNOLOGY

The present invention relates to a sealed single-dose break-open package comprising a pre-weakened area, a device and a method for making a weakened area.

PRIOR ART

Patent application WO2008038074A2 describes a sealed single-dose break-open package; the sealed package comprises a sheet of semirigid plastic material and a sheet of flexible plastic material, which is set on top of and welded to the first sheet of semirigid plastic material so as to define a sealed pocket that contains a dose of a fluid product. The sheet of semirigid plastic material centrally has a pre-weakened area, which guides a controlled breakage of the sheet of semirigid plastic material in order to cause the formation of an outlet opening for the product through the sheet of semirigid plastic material itself. In other words, in order to open the sealed package, a user must grab the sealed package itself with the fingers of one hand and fold the sealed package in a "V" shape until the sheet of semirigid plastic material breaks at the pre-weakened area. The pre-weakened area comprises an inner incision, which is obtained through an inner surface (namely, one facing the pocket) of the sheet of semirigid plastic material, and an outer incision, which is obtained through an outer surface of the sheet of semirigid plastic material and is aligned with the inner incision.

In patent application WO2008038074A2, the incisions vary in depth to cause a gradual breakage of the sheet of semirigid plastic material when folding the sealed package in a "V" shape. However, making incisions that vary in depth is relatively complicated as it requires the movement of the knives of the incision unit to be very precise; among other things, the movement of the knives of the incision unit tends to decrease in precision as the operating speed increases and, as a consequence, if aiming to obtain a very highly precise movement of the knives of the incision unit, particularly high operating speeds cannot be reached.

Furthermore, the sealed single-dose package described in patent application WO2008038074A2 does not allow the product contained in the package itself to be applied (spread) precisely and intuitively over a surface and, therefore, such package is not suited to containing spreadable products (or products spreadable over a surface).

To make the package, patent application WO2008038074A2 describes the use of a device comprising a reel for feeding a strip of semirigid material and a reel for feeding a strip of flexible material, an incision unit, and a package forming unit comprising a device for feeding the fluid and a sealing device. The incision unit has two parallel, facing plates, which are movable towards each other to grip the strip of semirigid plastic material and which support the knives. Each plate is pushed towards the other by a respective linear actuator so as to hold the strip of semirigid material and have each part thereof make an incision.

Furthermore, sealed single-dose break-open packages are known which have a Ω-shaped incision made in a central area of the sheet of semirigid plastic material. This incision allows the breakage of the package and the discharge of the product to be controlled. Once opened, the Ω shape of the incision allows a fluid product to be directly spread over the surface for application.

These packages also have drawbacks. When opened, the product tends to seep out from the lateral segments of the incision and, therefore, its distribution is not adequately controlled.

Moreover, known packages are not suited to dosing granular or powder products. When the product is in granules, it tends to spurt out of the package quickly upon opening. When the product is in powdered form, a certain quantity of residual product often remains inside the package.

DESCRIPTION OF THE INVENTION

The object of the present invention is to provide a sealed single-dose break-open package which allows a controlled distribution of the product.

According to one aspect of the present invention, a sealed single-dose break-open package is provided with features as disclosed herein.

Making a lateral incision at its edge enables a guided opening, which is then completed with the breakage of the sheet at the shaped central incision. Therefore, the product exits the central area rather than the lateral segment, which only serves to direct the folding of the package.

To make the pre-weakening, a device is provided with features as disclosed herein.

The pre-weakening is made according to a method with features as disclosed herein.

According to another aspect of the present invention, a sealed single-dose break-open package is provided that comprises a first sheet of semirigid plastic material; a second sheet of flexible plastic material set on top of and welded to the first sheet so as to define a sealed pocket that contains a dose of a product; wherein the first sheet of semirigid plastic material comprises a shaped incision positioned in a central portion of the first sheet, wherein the shaped incision has a least two inclined segments positioned symmetrically with respect to the centre of the sheet and joined to each other at one end so as to form two opposing sides of a triangle. This package enables liquid products to be dosed out in drops.

In a preferred embodiment, the incision has a plurality of adjacent pairs of inclined segments, wherein the segments in each pair are positioned symmetrically to each other and are joined to each other at one end so as to form two opposing sides of a triangle. This package enables granular and powder products to be dosed out optimally.

According to another aspect of the present invention, an incision tool is provided for making an incision in a sheet, in particular a sheet of semirigid plastic material, comprising a plate-shaped body, in particular rectangular, and at least one protrusion attached to one side of the plate, preferably a longer side of the plate, wherein the protrusion has a substantially "V"-shaped recess.

Using this incision tool, a "V"-shaped incision can be made to enable liquid products to be distributed in drops.

According to an advantageous embodiment, the incision tool comprises a plurality of protrusions, preferably adjacent, each having a substantially "V"-shaped recess. Using this incision tool, a "zig-zag" incision can be made to enable the controlled distribution of granular and powdered products.

BRIEF DESCRIPTION OF THE DRAWINGS

The present invention will now be described with reference to the accompanying drawings, which show some non-limiting examples of implementations, in which.

PREFERRED IMPLEMENTATIONS OF THE INVENTION

Figure 1:
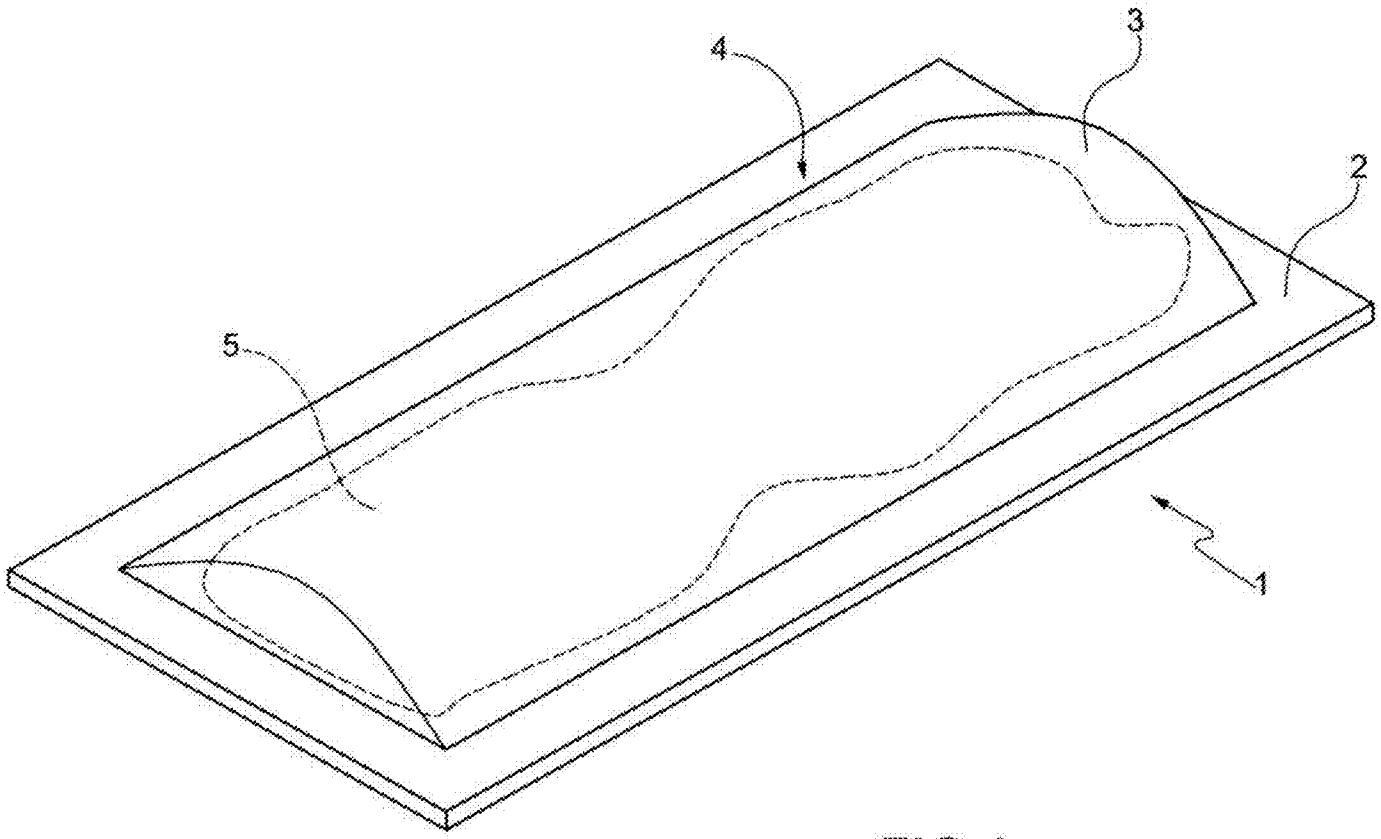
FIG. 1 shows a perspective view of a sealed single-dose break-open package made in accordance with the present invention.

In FIG. 1, the number 1 indicates a complete sealed single-dose break-open package. The sealed single-dose package 1 comprises a sheet 2 of semirigid plastic material and a sheet 3 of flexible plastic material, which is set on top of and welded to the sheet 2 of semirigid plastic material so as to define (between the two sheets 2 and 3) a sealed pocket 4 that contains a dose of a product 5.

In the embodiment shown, the sheet 2 of semirigid plastic material and the sheet 3 of flexible plastic material have a substantially rectangular shape. The sealed single-dose package 1 could have any other shape: round, elliptic, "bottle"-shaped, rhomboid, pentagonal, hexagonal, triangular, square, "bone"-shaped. The sheet 2 of semirigid plastic material and the sheet 3 of flexible plastic material are substantially flat. The sheet 2 of semirigid plastic material is obtained from a strip of semirigid plastic material. The strip of semirigid plastic material preferably has a thickness of between approximately 200 microns and approximately 500 microns, in particular between approximately 200 microns and approximately 450 microns.

Figure 2:
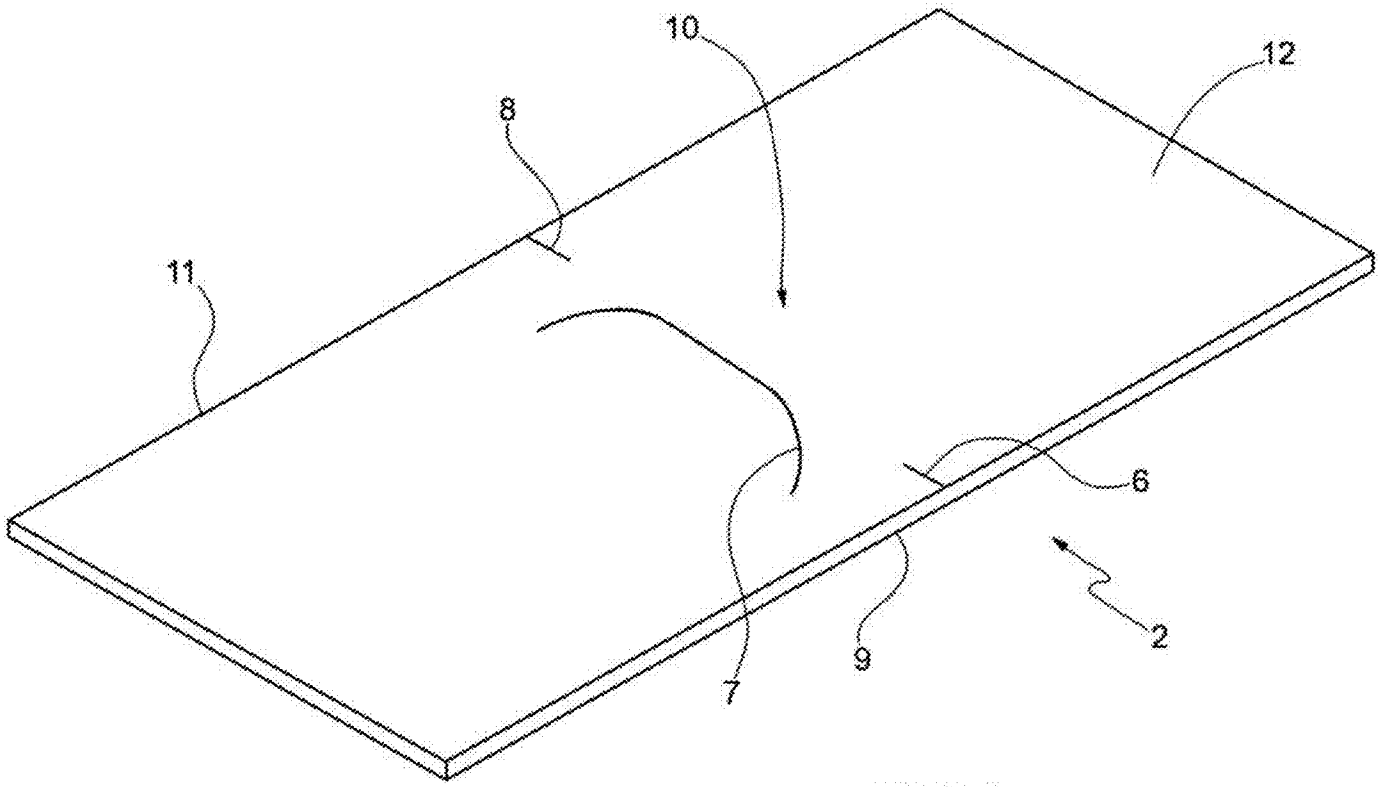
FIG. 2 shows a perspective view of a first sheet of the sealed package in FIG. 1, in a first embodiment.

FIG. 2 shows an embodiment of the present invention.

According to the invention, the first sheet 2 of the package 1 comprises at least one substantially straight pre-weakened incision 6 positioned at a first edge 9 of the first sheet 2, and at least one shaped incision 7 positioned in a central portion 10 of the first sheet 2, laterally and at a distance from the substantially straight first incision 6.

In particular, the first straight incision 6 starts at the first edge 9 and extends towards the centre of the package 1. The first straight incision 6 is substantially perpendicular to the first edge 9 of the package 1.

The incisions 6, 7 have the function of guiding, by following a fold in the sealed package 1, a controlled breakage of the first sheet 2 in order to cause the formation of an outlet opening for the product 5 through the first sheet 2 itself.

Preferably, the package 1 comprises at least one substantially straight second incision 8 positioned at a second edge 11 of the first sheet 2, opposite to the first edge 9, laterally and at a distance from the shaped incision 7.

In particular, the second straight incision 8 starts at the second edge 11 and extends towards the centre of the package 1. The second straight incision 8 is substantially perpendicular to the second edge 11 of the package 1.

In particular, the two lateral incisions 6, 8 consist of two respective straight segments which are identical in size and aligned to each other. The two lateral incisions 6, 8 do not connect with the shaped central incision 7, but are made up of segments spaced apart from it. In other words, a residual portion of the sheet 2 of semirigid plastic material is interposed between the two straight lateral incisions 6, 8 and the shaped central incision 7.

The shaped incision 7 is not a through-incision, which is to say it does not pass through the first sheet 2 of semirigid plastic material. In particular, the incision 7 is made by the plastic deformation of the semirigid plastic material constituting the first sheet 2.

Preferably, the straight incision 6 and/or the straight incision 8 is not a through-incision, which is to say it does not pass through the first sheet 2 of semirigid plastic material. In particular, the straight incision 6 and/or the straight incision 8 is made by the plastic deformation of the semirigid plastic material constituting the first sheet 2.

In the embodiment shown, the incisions 6, 7, 8 are not through-incisions, which is to say they do not pass through the first sheet 2 of semirigid plastic material.

In the embodiment shown in FIG. 2, the first sheet 2 comprises a central incision 7 shaped as a curved line, a first straight incision 6 at the first edge 9 and a second straight incision 8 at the opposite edge 11.

In a first embodiment, the central incision 7 and the lateral incision 6 are made on the same surface of the sheet 2 of semirigid plastic material, preferably on the inner surface 12 facing the pocket 4, as shown in FIG. 2.

In a preferred embodiment, the shaped central incision 7 is obtained on an inner surface 12 (namely, one facing the pocket 4) of the sheet 2 of semirigid plastic material, while the straight lateral incision 6 is obtained on an outer surface 13 (namely, one opposite the pocket 4) of the sheet 2 of semirigid plastic material.

Figure 3:
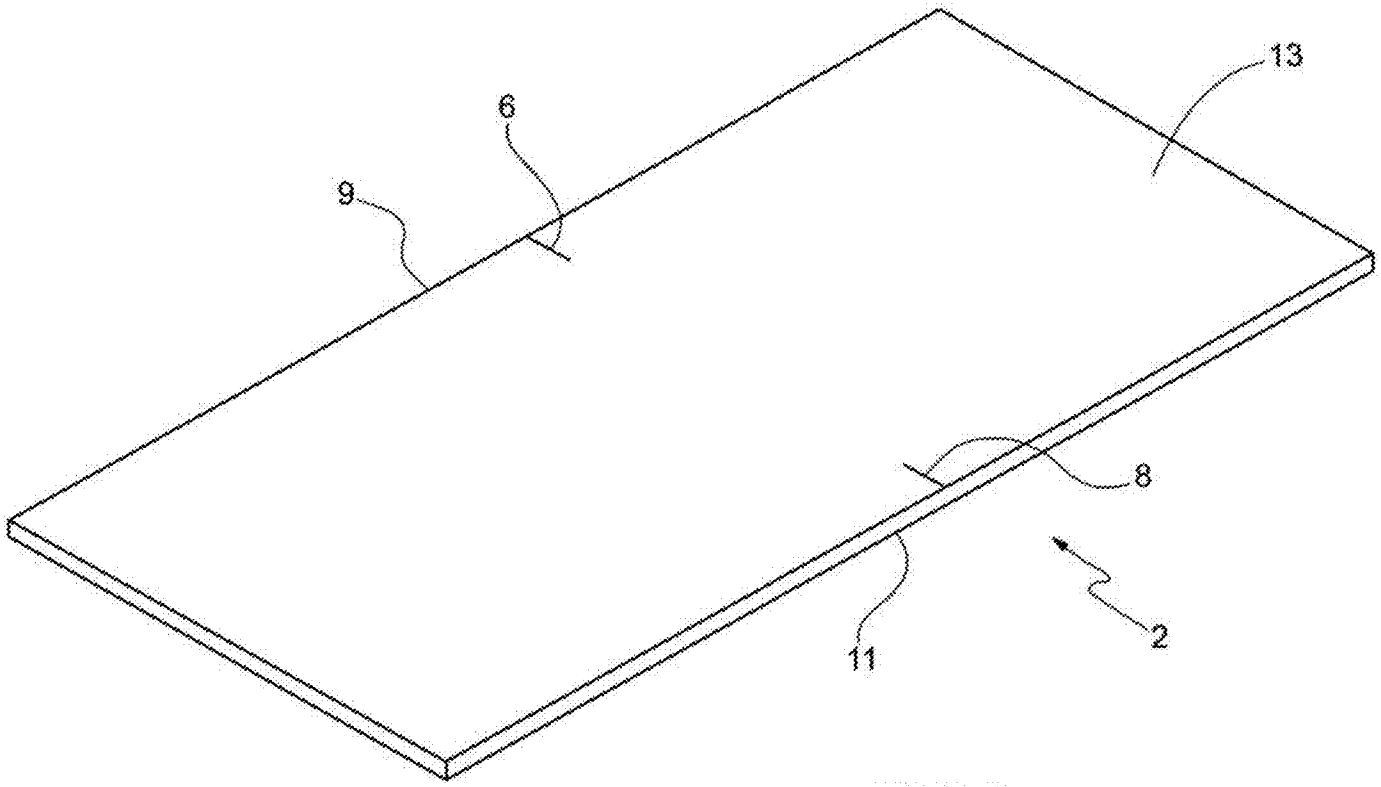
FIG. 3 is a perspective view of an outer surface of the first sheet of the sealed package in FIG. 1, in a second embodiment.
Figure 4:
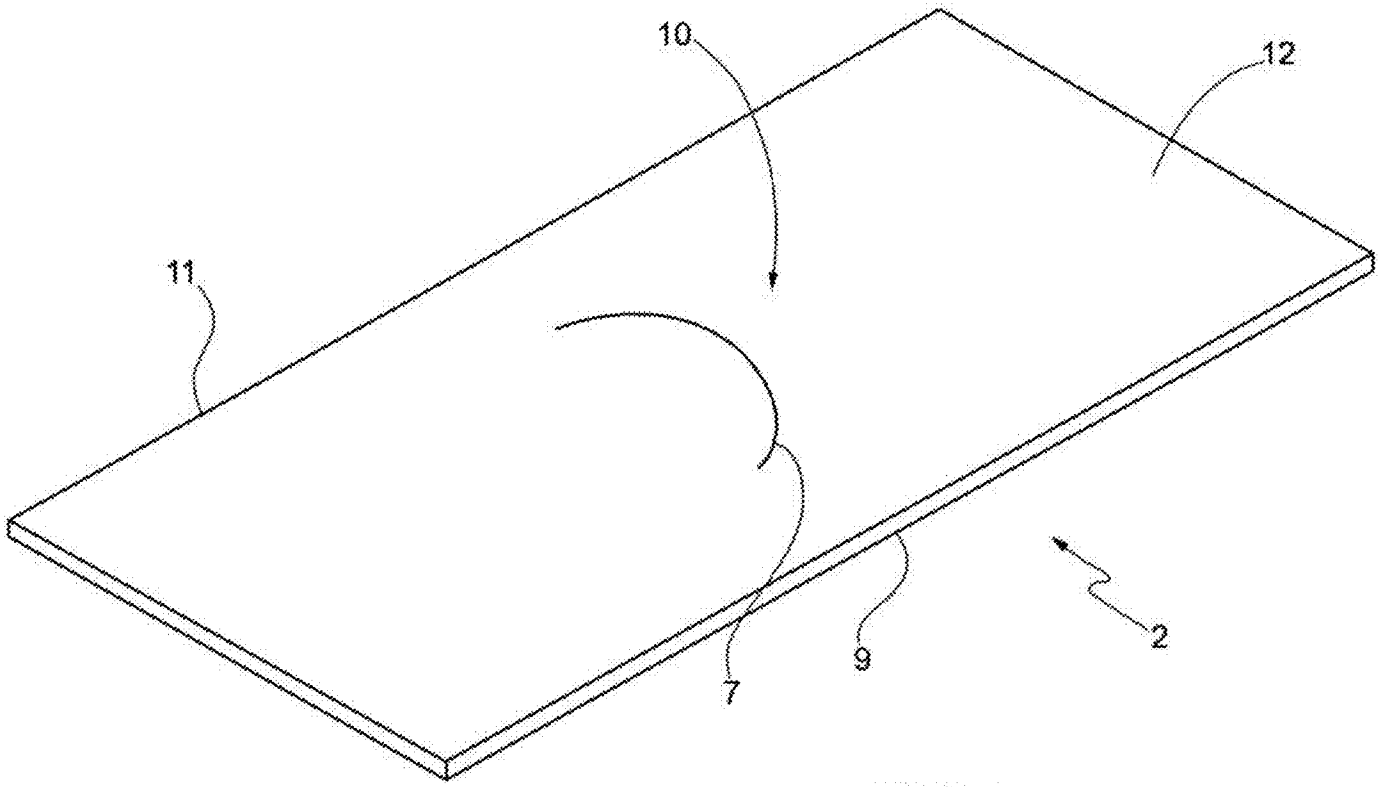
FIG. 4 is a perspective view of an inner surface of the first sheet of the sealed package in FIG. 1, in the second embodiment.

In the embodiment shown in FIGS. 3 and 4, the shaped central incision 7 is obtained on the inner surface 12 of the sheet 2 of semirigid plastic material, while the straight incisions 6, 8 are obtained on the outer surface 13 of the sheet 2 of semirigid plastic material.

Figure 5:
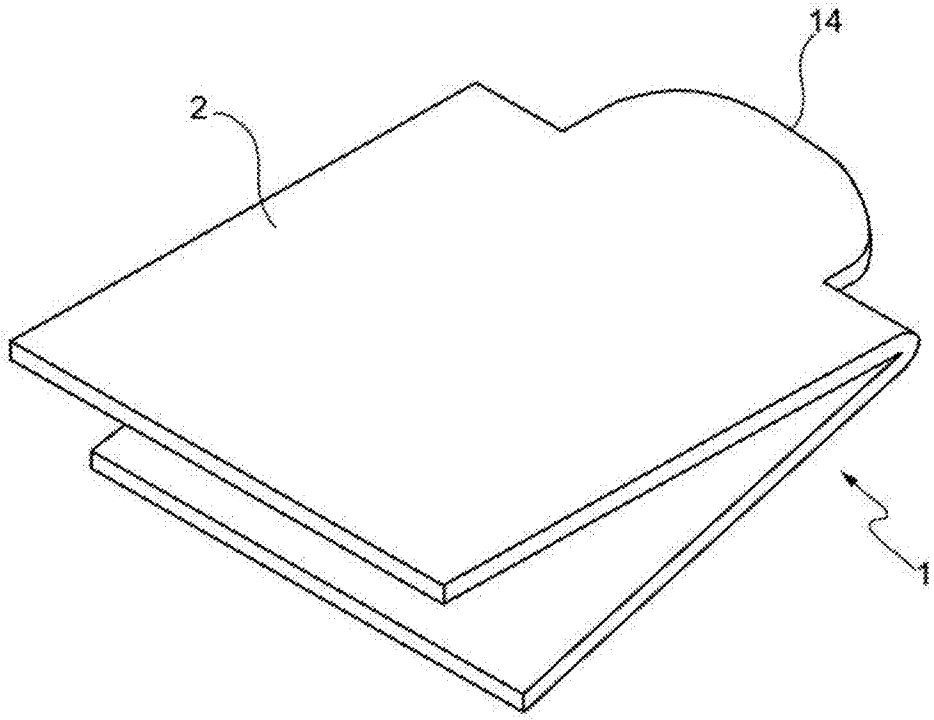
FIG. 5 is a perspective view of the package in FIG. 2, in a folded configuration.

In use, in order to open the sealed single-dose package 1, a user must grab the package 1 itself with the fingers of one hand and fold it in a "V" shape (as shown in FIG. 5) at the lateral incisions 6, 8 until breaking the sheet of semirigid plastic material 2 at the central incision 7. By breaking the sheet 2 of semirigid plastic material at the central incision 7, the portion delimited by the curve detaches from the semirigid sheet to form a protrusion 14 substantially shaped as an arc of a circle or semi-ellipse at the product outlet area. The product 5 can then be simply and hygienically released from the sealed single-dose package 1.

According to the illustrations in FIGS. 6-9, the central incision 7 extends along a single broken or zig-zag line; which is to say, a line consisting of at least two oriented consecutive and non-aligned segments 15, 16 (namely, so that the second end of one segment coincides with the first end of the next segment).

Figure 6:
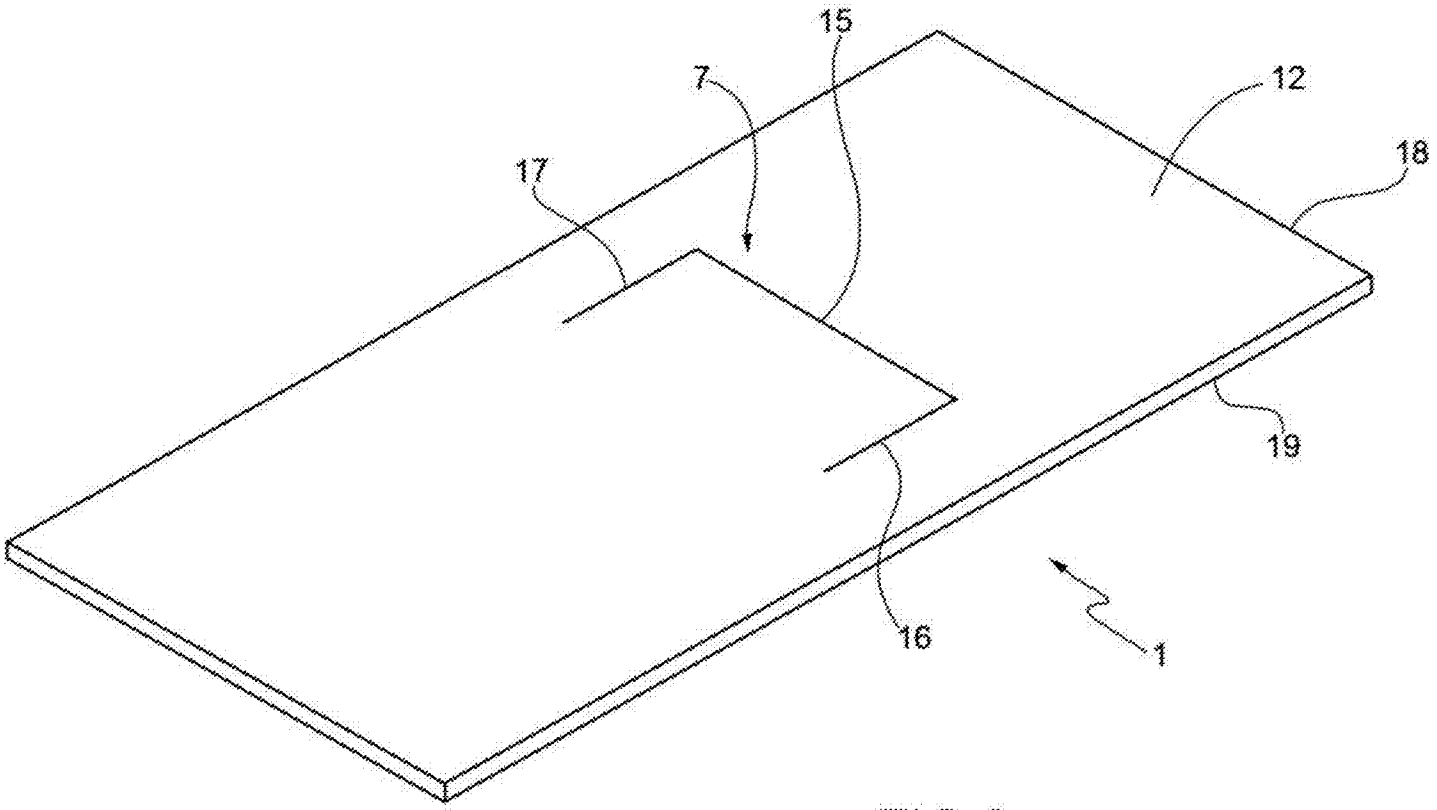
FIG. 6 is a perspective view of a surface of the first sheet of the sealed package, in a third embodiment.

In the embodiment in FIG. 6, the shaped central incision 7 consists of a main segment 15 which is substantially parallel to a smaller side 18 of the rectangular package 1 and two segments 16, 17 which are substantially parallel to each other and substantially perpendicular to the main segment 15 and to the larger side 19 of the rectangular package 1. In such embodiment, when the package 1 is opened, the portion delimited by the segments 15, 16, 17 detaches from the semirigid sheet 2 to form a substantially rectangular protrusion at the product outlet area.

The packages shown in FIGS. 2-6 are particularly suitable for dense fluid products, such as creams and glues, since, after opening, the protrusion allows the product to be distributed over the surface.

Figure 7:
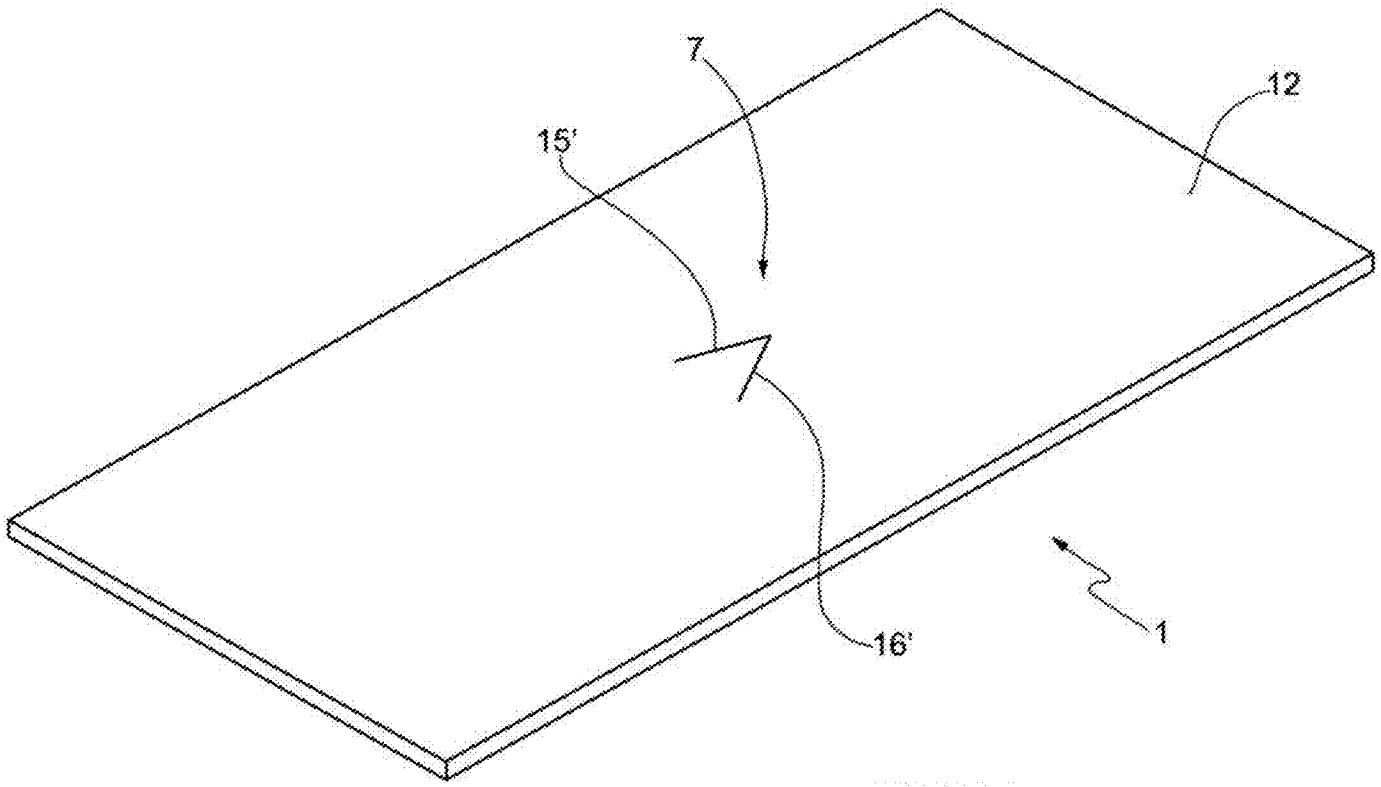
FIG. 7 is a perspective view of a surface of the first sheet of the sealed package, in a fourth embodiment.
Figure 8:
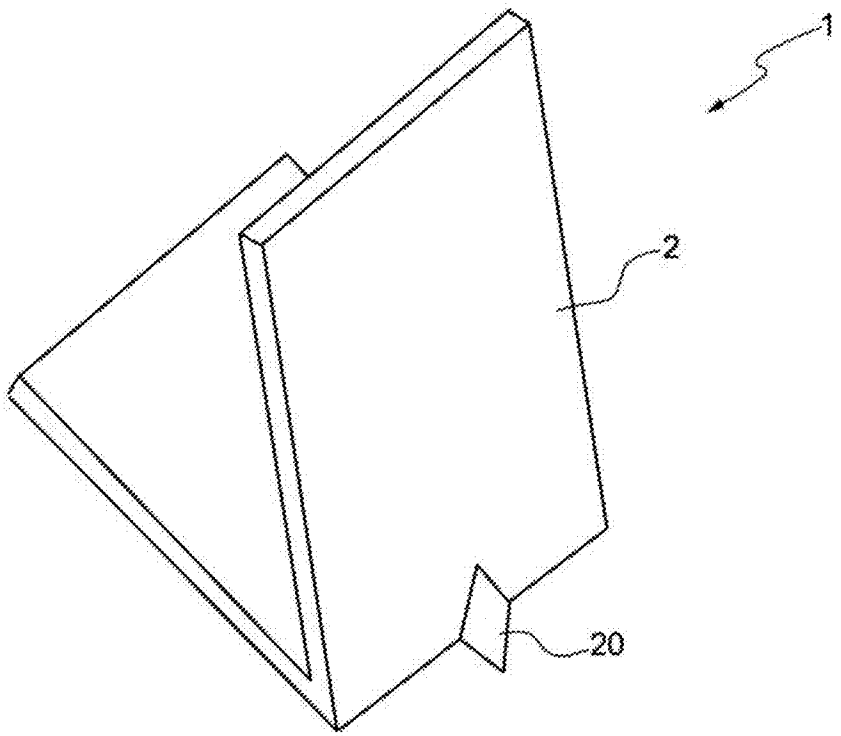
FIG. 8 is a perspective view of the package in FIG. 7, in a folded configuration.
Figure 9:
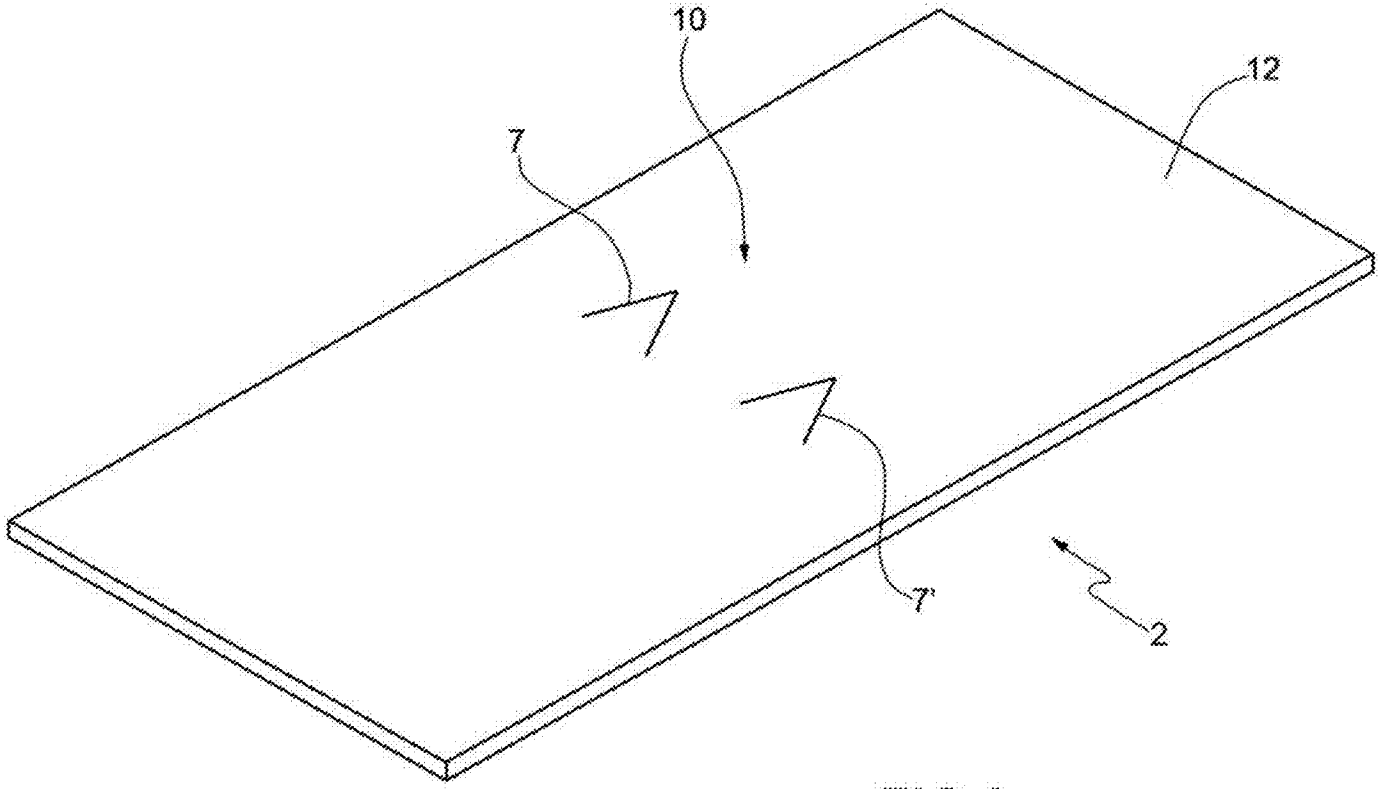
FIG. 9 is a perspective view of a surface of the first sheet of a sealed double-dose package.

In the embodiments shown in FIGS. 7-9, the shaped incision 7 comprises at least two inclined segments 15', 16' positioned symmetrically with respect to the centre of the sheet 2 and joined to each other at one end so as to form two opposing sides of a triangle, in particular an isosceles triangle.

In the embodiment in FIG. 7, the two inclined segments 15', 16' form the two opposing sides of an isosceles triangle. In this embodiment, when the package 1 is opened, the portion delimited by the segments 15', 16' detaches from the semirigid sheet 2 to form a substantially triangular protrusion 20 at the product outlet area (FIG. 8). This configuration is particularly suitable for liquid products that must be distributed in drops, since the triangular protrusion 21 allows the liquid to be dosed out by sliding it along the triangle up to the vertex, from where it detaches to form the drop.

In one embodiment, the "V"-shaped incision is made without making the lateral incisions, while still allowing the product to be distributed in drops. Thus, a sealed single-dose break-open package is obtained that comprises a first sheet 2 of semirigid plastic material; a second sheet 3 of flexible plastic material set on top of and welded to the first sheet 2 so as to define a sealed pocket 4 that contains a dose of a product 5; wherein the first sheet 2 of semirigid plastic material comprises at least one shaped incision 7, which is positioned in a central portion 10 of the first sheet 2 and has at least two inclined segments 15', 16' positioned symmetrically with respect to the centre of the sheet 2 and joined to each other at one end so as to form two opposing sides of a triangle.

FIG. 9 shows an embodiment of a double-dose package, wherein two pockets are obtained. Such package is suitable for dual-component products that must be mixed after opening. In these packages, two shaped central incisions 7, 7' are made at a space apart from each other. The central incision can be of different shapes, for example "V"-shaped, semi-elliptic or rectangular.

Figure 10:
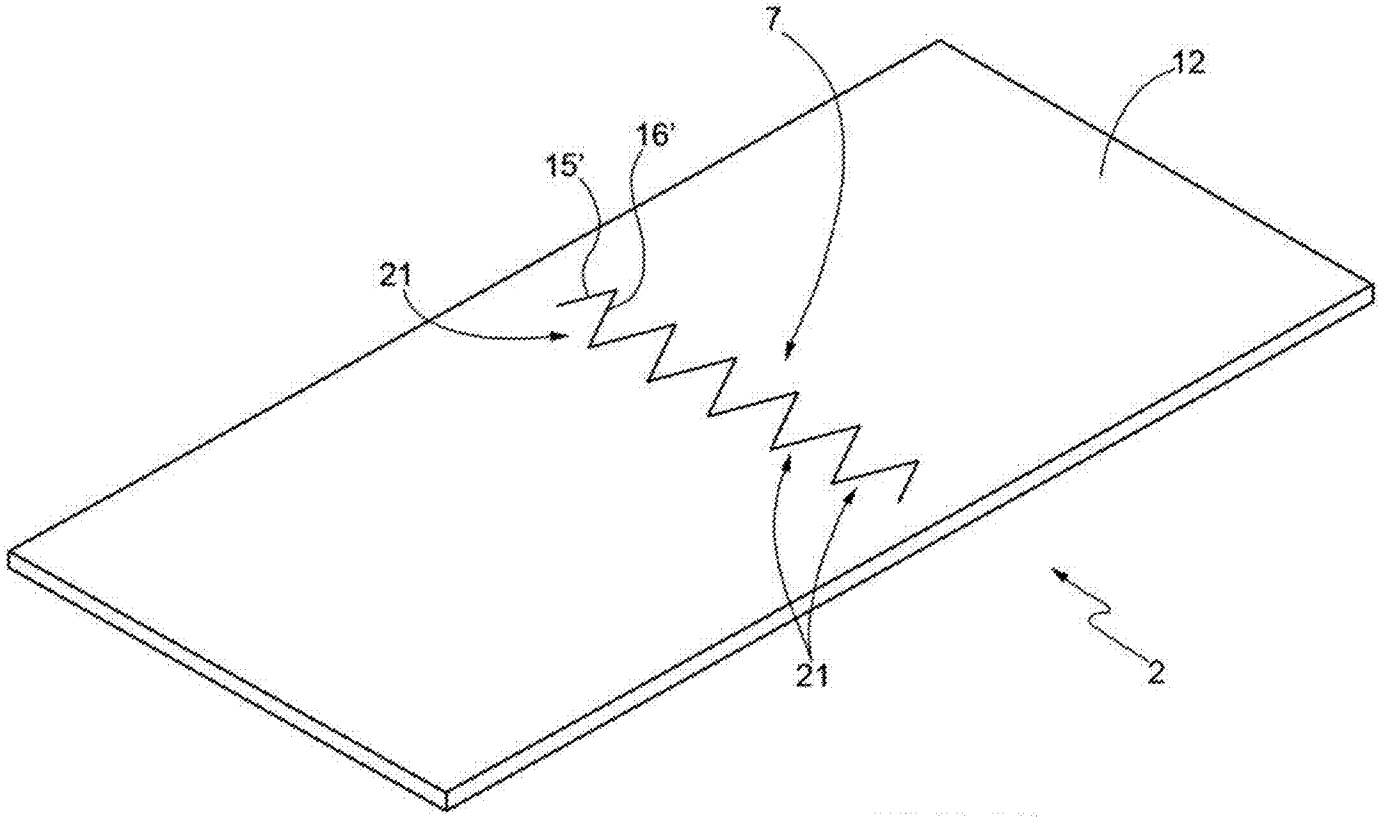
FIG. 10 is a perspective view of a surface of the first sheet of the sealed package, in a fifth embodiment.

In the embodiment in FIG. 10, the shaped incision 7 comprises a plurality of adjacent pairs 22 of inclined segments 15', 16', wherein the segments 15', 16' in each pair 22 are positioned symmetrically to each other and are joined to each other at one end so as to form two opposing sides of a triangle. In other words, the pairs 22 of inclined segments 15', 16' form a "zigzag" profile, which extends into the central portion 10 of the package.

Figure 11:
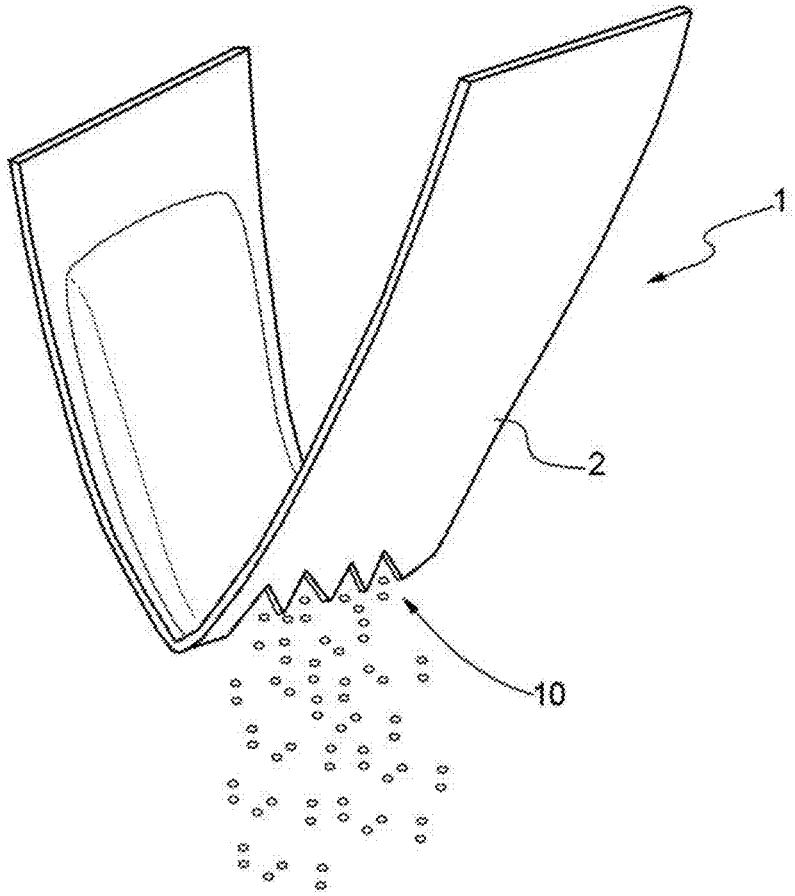
FIG. 11 shows a first step of opening the package in FIG. 10.
Figure 12:
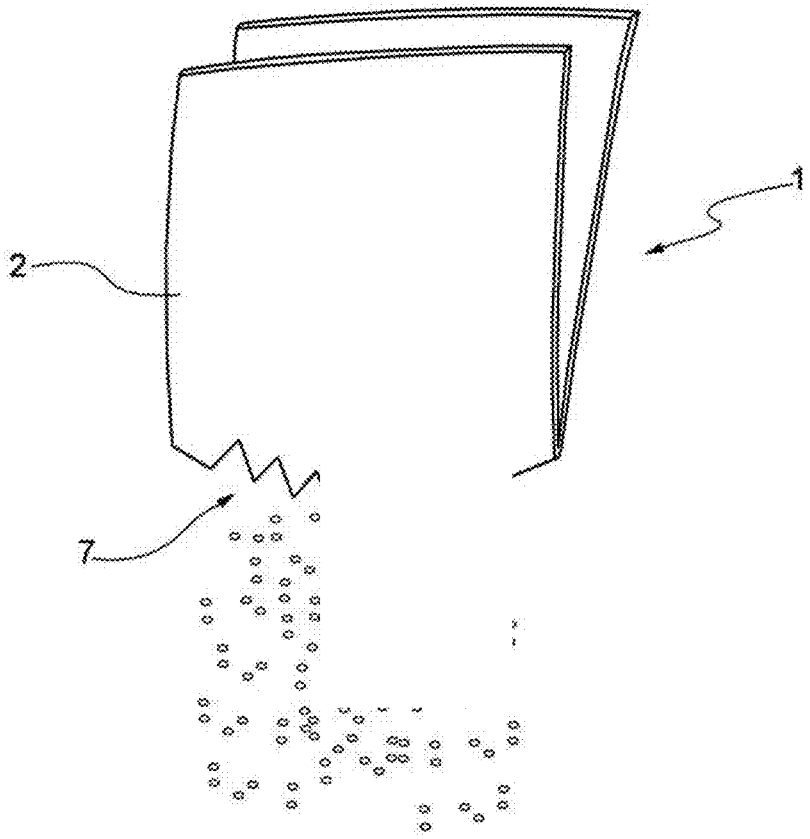
FIG. 12 shows a second step of opening the package in FIG. 10.

In this embodiment, the package 1 can be opened in two steps. In a first step, the package 1 is folded along the two straight lateral segments 6, 8, in such a way that the central incision 7 opens up to present a series of adjacent triangles from which the product slowly comes out (FIG. 11). In a second step, by acting perpendicularly relative to the straight lateral segments 6, 8, a complete opening is made at the central incision 7 in such a way that the product comes out completely (FIG. 12). This configuration is particularly suitable for granulated or powdered products, because it allows the product to be dosed out in the first step and, if appropriate, allows the package to be emptied completely in the second step.

The dimensions of the incised portions vary according to the dimensions of the package and/or the quantity and density of the product it contains.

In one embodiment, the "zig-zag" incision is made without obtaining the lateral incisions, while still allowing the product to be distributed in a controlled manner.

Advantageously, the shaped incision 7 has a substantially constant depth (net of inevitable construction tolerances) along its length.

Advantageously, the first straight incision 6 and/or the second straight incision 8 has a substantially constant depth (net of inevitable construction tolerances) along its length.

Preferably, the depth of the shaped incision 7 is greater than the depth of the first straight incision 6 or the second straight incision 8.

Advantageously, the depth of the first straight incision 6 and/or the second straight incision 8 is approximately ⅓ of the thickness of the first sheet 2. Preferably, the depth of the shaped incision 7 is approximately ⅔ of the thickness of the first sheet 2.

In a further preferred embodiment, the depth of the shaped incision 7 is ≥70% of the thickness of the first sheet 2 of semirigid plastic material. The shaped incision 7 is not a through-incision, which is to say it does not pass through the first sheet 2 of semirigid plastic material.

The depth of the first shaped incision 6 and/or the second straight incision 8 is ≤40% of the thickness of the first sheet 2 of semirigid plastic material. In particular, the depth of the first shaped incision 6 and/or the second straight incision 8 is between 20% and 40% of the thickness of the first sheet 2 of semirigid plastic material.

The first sheet 2 of semirigid plastic material is obtained from a single strip of material. The strip of material from which the sheet 2 is obtained is preferably formed by a laminate.

The laminate comprises at least one supporting layer 22, one heat-sealable layer 25 and one insulating layer 24 interposed between the supporting layer 22 and the heat-sealable layer 25. The insulating or barrier layer 24 aims to ensure impermeability to air and/or light. In the sheet 2 constituting the package 1, the supporting layer 22 is positioned on the outside (namely, on the side opposite the pocket 4 at the outer surface 13) and the heat-sealable layer 25 is positioned on the inside (namely, on the same side as the pocket 4 at the inner surface 12).

Figure 13:
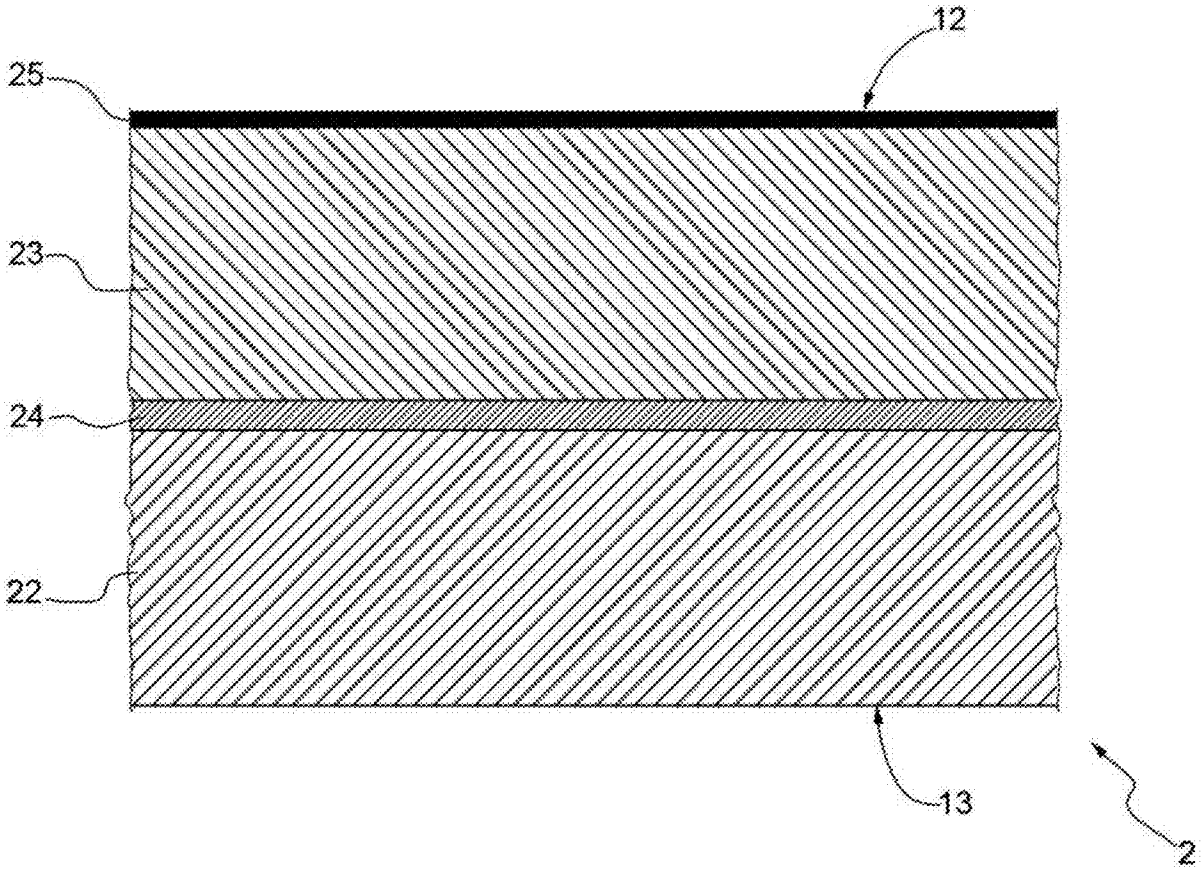
FIG. 13 shows a schematic cross-section of a semirigid sheet constituting the sealed package.

As exemplified in the embodiment shown in FIG. 13, the sheet 2 of semirigid plastic material is a laminate and comprises a supporting layer 22 positioned on the outside (namely, on the side opposite the pocket 4 at the outer surface 13) and a supporting layer 23 positioned on the inside (namely, on the same side as the pocket 4 at the inner surface 12). Between the two supporting layers 22 and 23, an insulating or barrier layer 24 is provided with the aim of ensuring impermeability to air and/or light; in other words, the barrier layer 24 is enclosed between the two supporting layers 22 and 23 and separates the supporting layers 22 and 23 from each other. Preferably, the supporting layer 23 is clad in a heat-sealable layer 25 that is positioned on the inside (namely, on the same side as the pocket 4 and in contact with the sheet 3 of flexible plastic material so as to perform heat-sealing together with the sheet 3 of flexible plastic material itself).

According to some embodiments shown in the accompanying figures, the two supporting layers 22 and 23 can have the same thickness; however, according to other implementations, the two supporting layers 22 and 23 can have different thicknesses, which is to say, the thickness of the supporting layer 22 can be different from the thickness of the supporting layer 23.

By way of a non-limiting example, the sheet 2 of semirigid plastic material could be composed of: a white polystyrene (PS) supporting layer 22 with a thickness of between 100 microns and 200 microns (+10%), an EVOH or dialuminium barrier layer 24 with a thickness of 10 microns (+10%), a white polystyrene (PS) supporting layer 23 with a thickness of between 100 microns and 200 microns (+10%), and a polyethylene (PE) heat-sealable layer 25 with a thickness of 50 microns (+10%). Alternatively, the supporting layers 22 and 23 could be made of preferably biaxially-oriented polylactic acid (PLA) and/or the heat-sealable layer 25 could be made of polypropylene (PP). Polylactic acid (PLA) is generally heat-sealable and, therefore, when the supporting layers 22 and 23 are made of polylactic acid (PLA), the heat-sealable layer 25 could be absent, since the sheet 3 of flexible plastic material could be directly heat-sealable to the polylactic acid (PLA) supporting layer 23. Moreover, when polylactic acid (PLA) or polypropylene (PP) is used to make the supporting layers 22 and 23, the thickness of the supporting layers 22 and 23 can be reduced, since polylactic acid (PLA) and polypropylene (PP) enable sufficiently rigid supporting layers 22 and 23 to be obtained even where these are of modest thickness. By way of example, when the supporting layers 22 and 23 are made of polystyrene (PS), the overall thickness of the supporting layers 22 and 23 must be greater than 350-380 microns, whereas when the supporting layers 22 and 23 are made of polylactic acid (PLA) or polypropylene (PP), the overall thickness of the supporting layers 22 and 23 can be as low as 200 microns.

According to a different embodiment (not shown), the sheet 2 of semirigid plastic material does not have the supporting layer 23 (namely, the barrier layer 24 is in direct contact with the heat-sealable layer 25). The supporting layer 22 has a double thickness (namely, the supporting layer 23 is "incorporated" into the supporting layer 22).

The straight incisions 6, 8 obtained on the outer surface 13 of the sheet 2 of semirigid plastic material are advantageously made by locally deforming the sheet 2 of semirigid plastic material and, in particular, the supporting layer 22 of the sheet 2 of semirigid plastic material. Preferably, the straight incisions 6, 8 stop before the barrier layer 24 and therefore do not affect the barrier layer 24 itself.

The shaped incision 7 obtained on the inner surface 12 of the sheet 2 of semirigid plastic material is advantageously made by locally deforming the sheet 2 of semirigid plastic material and, in particular, the supporting layer 23 of the sheet 2 of semirigid plastic material. Preferably, the shaped incision 7 stops before the barrier layer 24 and therefore does not affect the barrier layer 24 itself.

At the shaped central incision 7, the heat-sealable layer 25 can be deformed or torn (partially or completely); in any case, at the shaped incision 7 obtained on the internal surface 12 there is no weld of any kind between the sheet 2 of semirigid plastic material and the sheet 3 of flexible plastic material and, therefore, any local damage to the heat-sealable layer 25 has no consequences of any kind.

In some embodiments, the barrier layer 24 can be placed between the two supporting layers 22 and 23 to form a barrier for the product contained in the sealed pocket 4. In some embodiments, the incisions 6, 7, 8 cannot affect the barrier layer 24. In some embodiments, the barrier layer 24 could have a sufficient thickness or robustness to allow the incisions to partly penetrate them, provided that the barrier layer 24 is capable of maintaining its function as a barrier. The integrity of the barrier layer 24 of the sheet 2 of semirigid plastic material in some embodiments ensures a barrier and therefore a seal for the contents of the sealed pocket 4 also at the incisions 6, 7, 8 and, therefore, the sealed pocket 4 is also suitable for containing perishable and/or controlled bacterial products such as foodstuffs, medicines or cosmetics. When the sealed single-dose package 1 is opened by making a "V"-shaped fold in the sealed single-dose package 1 itself, all of the supporting layers 22 and 23, the barrier layer 24 and the heat-sealable layer 25 of the sheet 2 of material semirigid plastic must be broken at the central incision.

In a further embodiment, the shaped incision 7 is made on the same side as the pocket 4 at the internal surface 12 of the sheet 2 of semirigid plastic material in such a way as to cut the barrier layer 24. The shaped incision 7 then penetrates the heat-sealable layer 25, the inner supporting layer 23 if present, the barrier layer 24 and reaches the outer supporting layer 22.

In an advantageous embodiment, the sheet 2 of semirigid plastic material is composed of a supporting layer 22, a barrier layer 24 and a heat-sealable layer 25. The shaped incision 7 penetrates the heat-sealable layer 25, the barrier layer 24 and reaches the outer supporting layer 22.

The supporting layer 22 is advantageously made of polystyrene (PS) or polylactic acid (PLA) or polypropylene (PP). The supporting layer 22 preferably has a thickness of between approximately 100 microns and approximately 500 microns (+10%), in particular between approximately 150 microns and approximately 400 microns. The supporting layer 22 still constitutes a barrier even when the barrier layer 24 is cut at the shaped incision 7 when making the incision itself.

Preferably, the depth of the shaped incision 7 is ≥70% of the thickness of the first sheet 2 of semirigid plastic material. The shaped incision 7 is not a through-incision, which is to say it does not pass through the first sheet 2 of semirigid plastic material.

The first straight incision 6 and/or the second straight incision 8 is made in the same side as the pocket 4 at the outer surface 13 of the sheet 2 of semirigid plastic material.

The depth of the first straight incision 6 and/or the second straight incision 8 is ≤40% of the thickness of the first sheet 2 of semirigid plastic material. In a preferred embodiment, the depth of the first straight incision 6 and/or the second straight incision 8 is between 20% and 40% of the thickness of the first sheet 2 of semirigid plastic material.

Advantageously, the depth of the first straight incision 6 and/or the second straight incision 8 is less than the thickness of the supporting layer 22.

Advantageously, the incisions 6, 7, 8 have a substantially constant depth (net of inevitable construction tolerances) along their length.

Advantageously, the incisions 6, 7, 8 are made by the plastic deformation of the material using respective incision tools that are provided with a rounded, unsharpened end for deforming, without cutting, the supporting layers 22 and 23 of the sheet 2 of semirigid plastic material.

According to one aspect of the present invention, an incision tool 26, 27 is provided for making an incision in a sheet, in particular a sheet of semirigid plastic material 2.

The incision tool 26, 27 comprises a plate-shaped body 28, in particular substantially rectangular, and at least one protrusion 29 attached to one side 30, preferably a longer side, of the plate 28, wherein the protrusion 29 has a substantially "V"-shaped recess 31.

Figure 14:
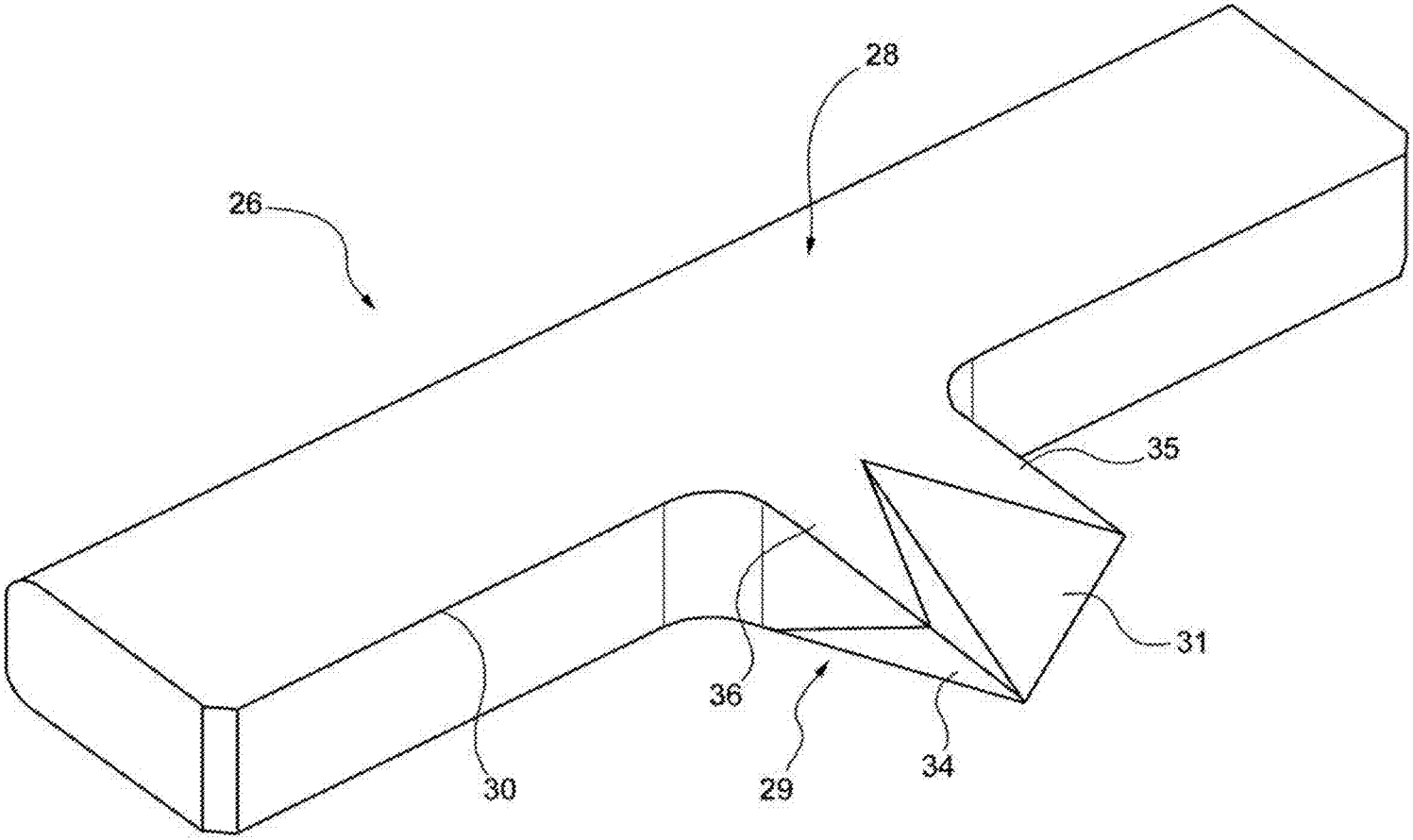
FIG. 14 is a perspective view of the top part of an incision tool for making a "V"-shaped incision.
Figure 15:
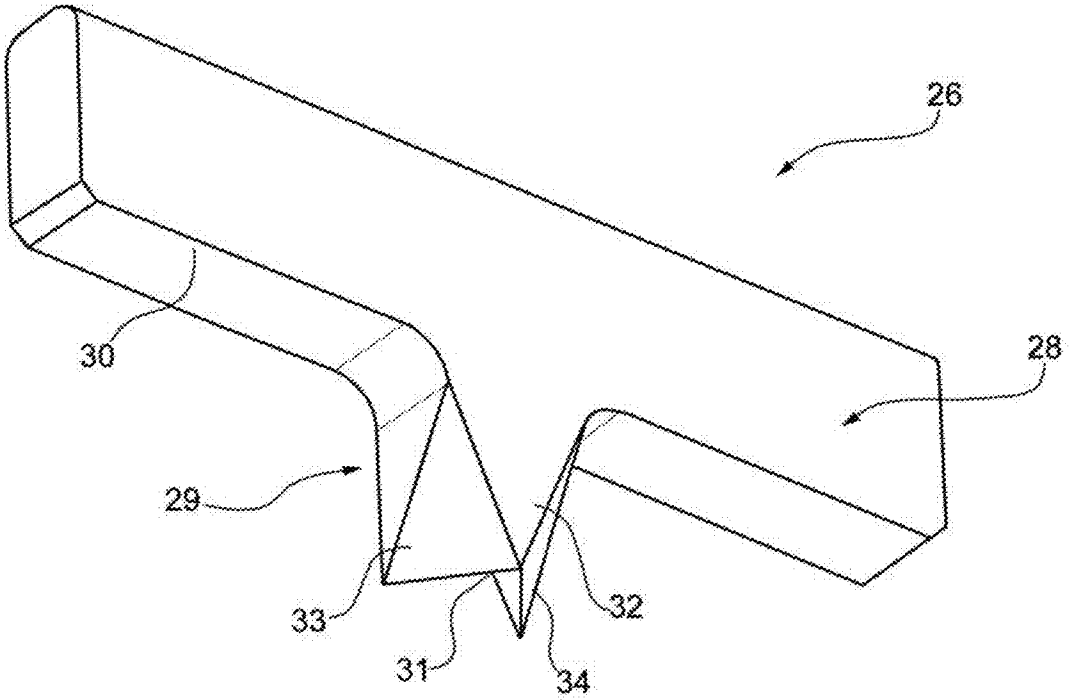
FIG. 15 is a perspective view of the bottom part of an incision tool for making a "V"-shaped incision.

FIGS. 14-15 show an embodiment of an incision tool 26 used for making the "V"-shaped incision.

The protrusion 29 of the incision tool 26 has a substantially triangular bottom wall 32. On each side of the triangle, a triangular lateral wall 33, 34 extends towards the top of the protrusion 29, inclined outwards so as to create a substantially "V"-shaped recess. From the edge of each lateral wall 33, 34 a substantially triangular portion 35, 36 extends in parallel to the bottom wall 32 of the protrusion 29.

Figure 16:
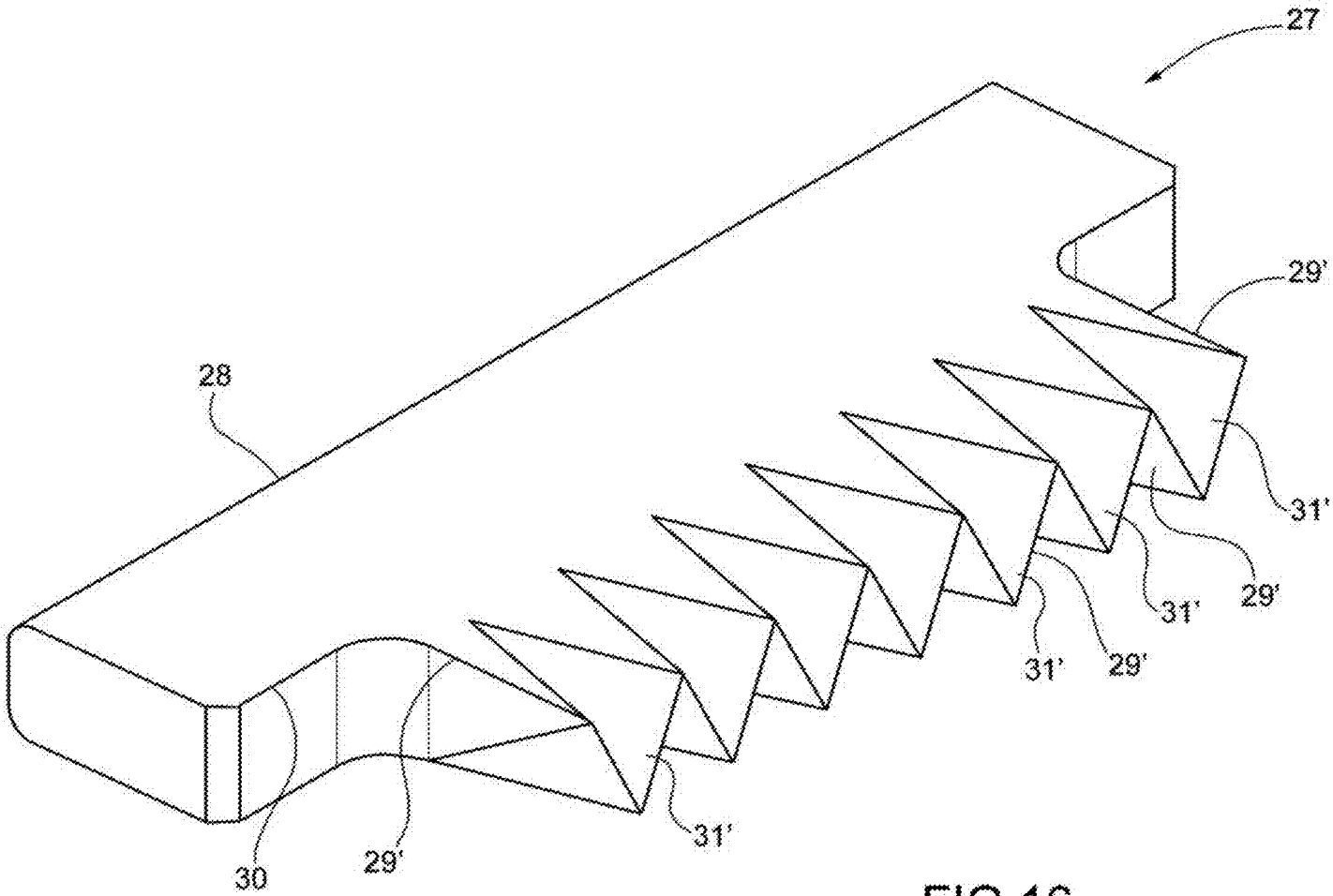
FIG. 16 is a perspective view of the top part of an incision tool for making a "zig-zag" incision.

An embodiment of an incision tool 27 used for making the "zig-zag" incision is shown in FIG. 16. The tool comprises a plurality of protrusions 29' which each have a substantially "V"-shaped recess 31'. Each protrusion 29' is made in the same way as with the single protrusion 29 for making the "V"-shaped incision. Preferably, the protrusions 29' are adjacent to each other.

Figure 17:
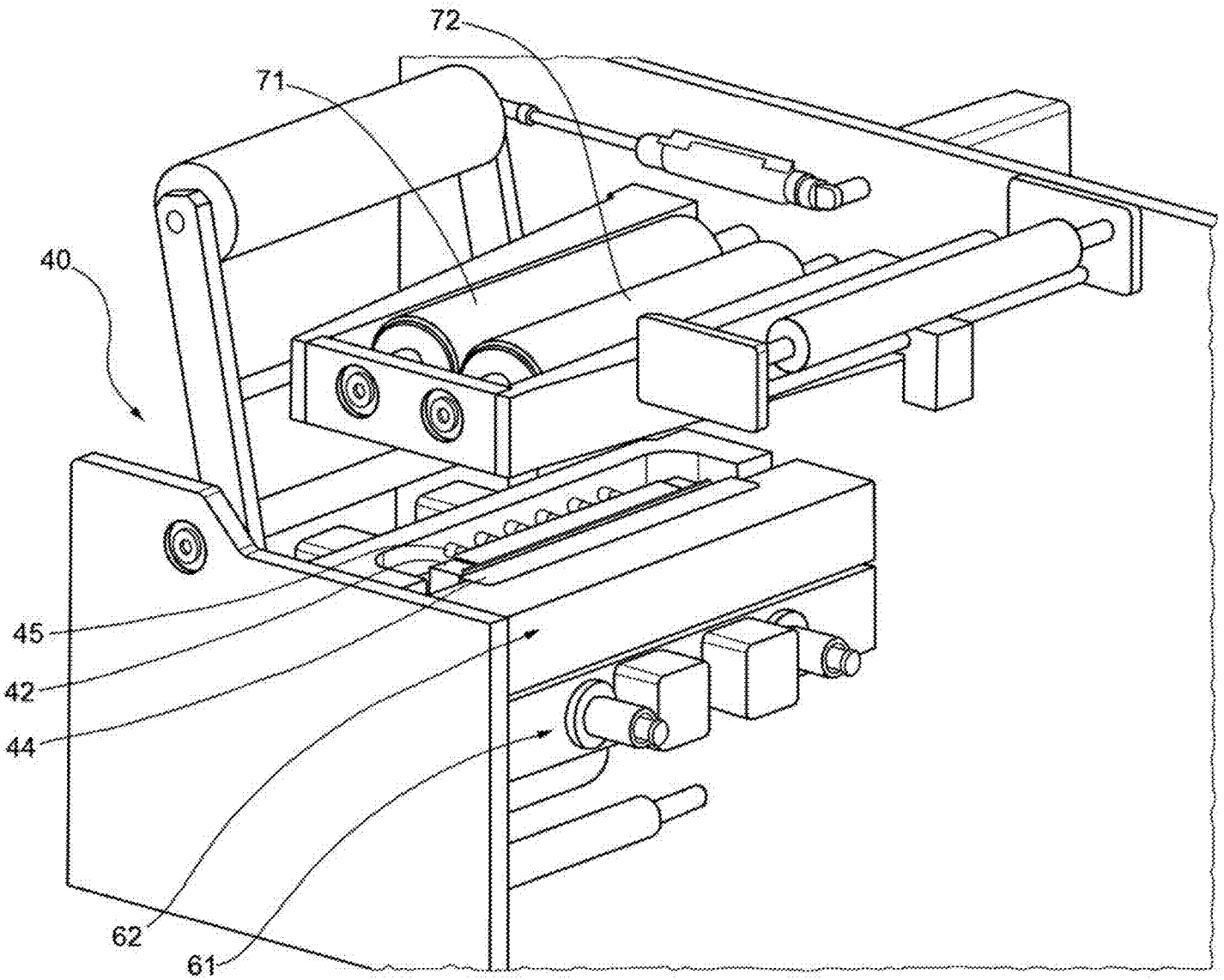
FIG. 17 is a perspective view of a device for making a weakening in a sheet, in a preferred embodiment.
Figure 18:
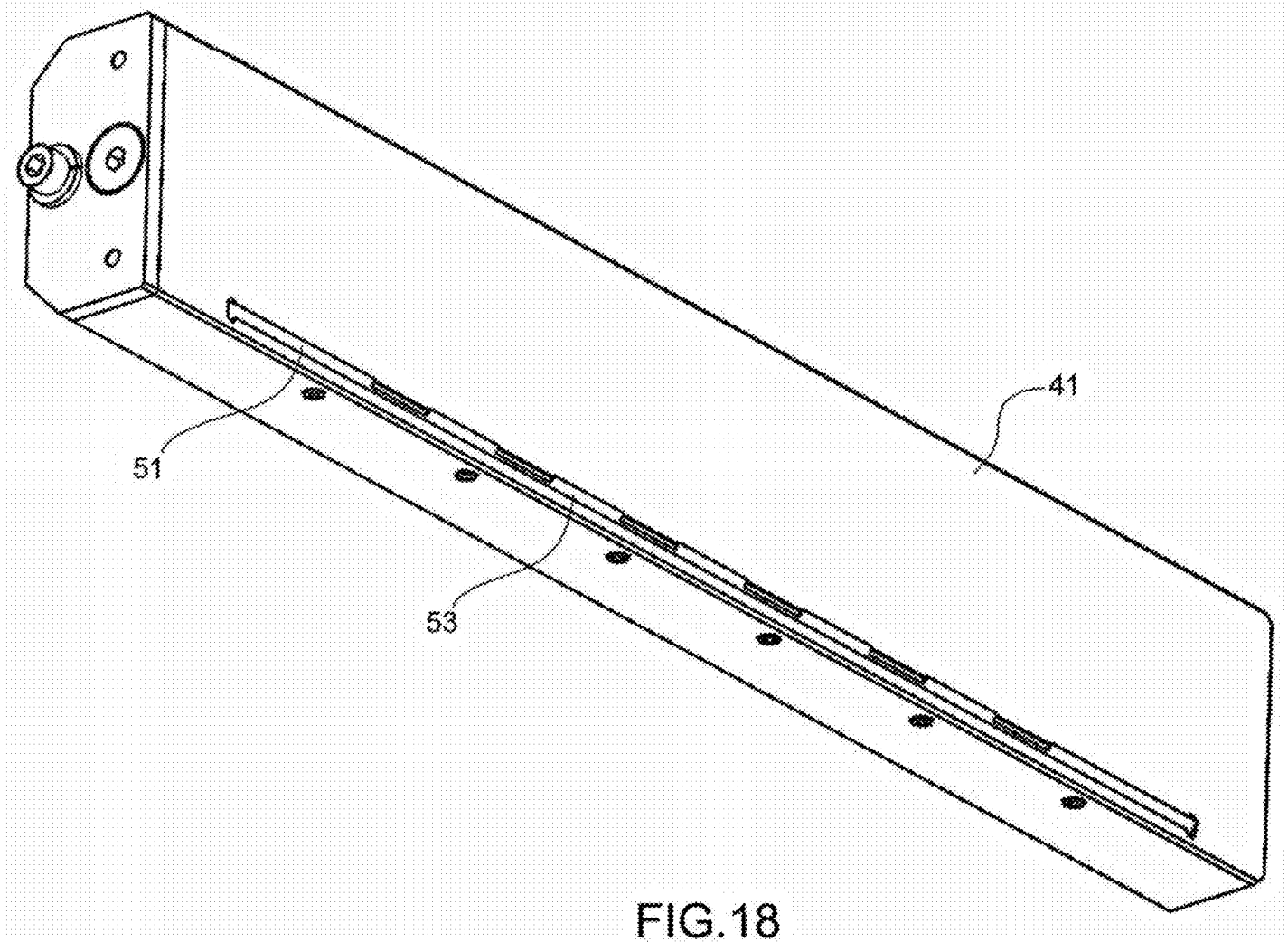
FIG. 18 is a perspective view of a plate attached to an incision tool for making a straight incision, in a preferred embodiment.
Figure 19:
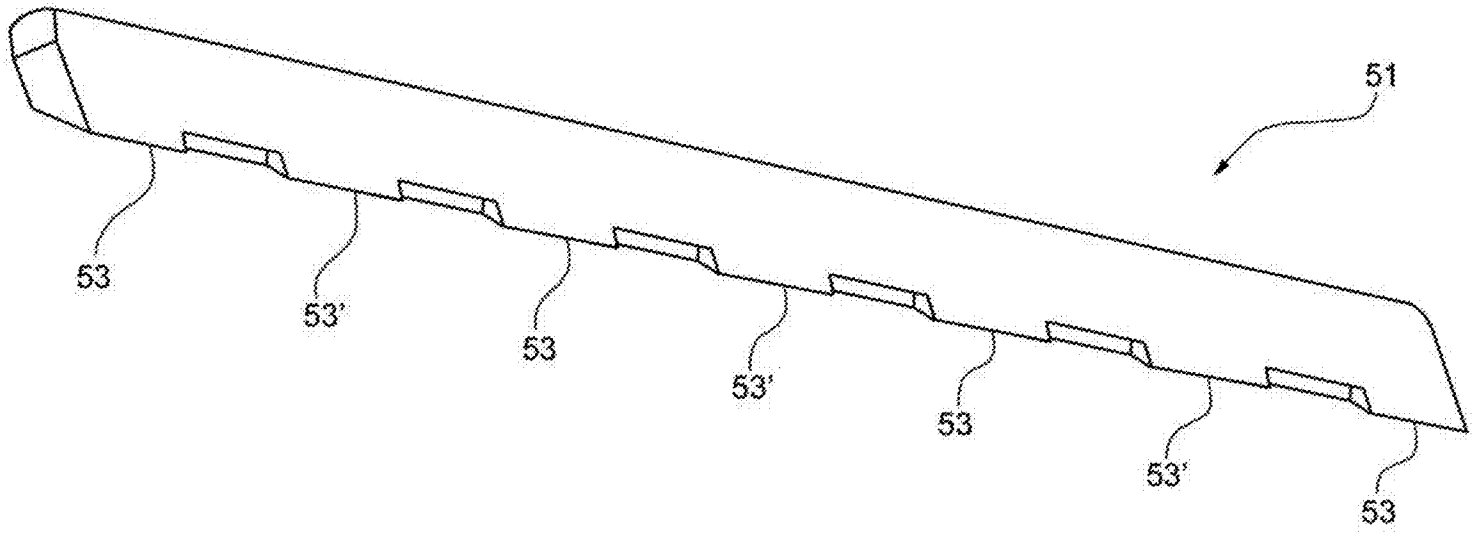
FIG. 19 is a perspective view of an incision tool for making a straight incision, in a preferred embodiment.
Figure 20:
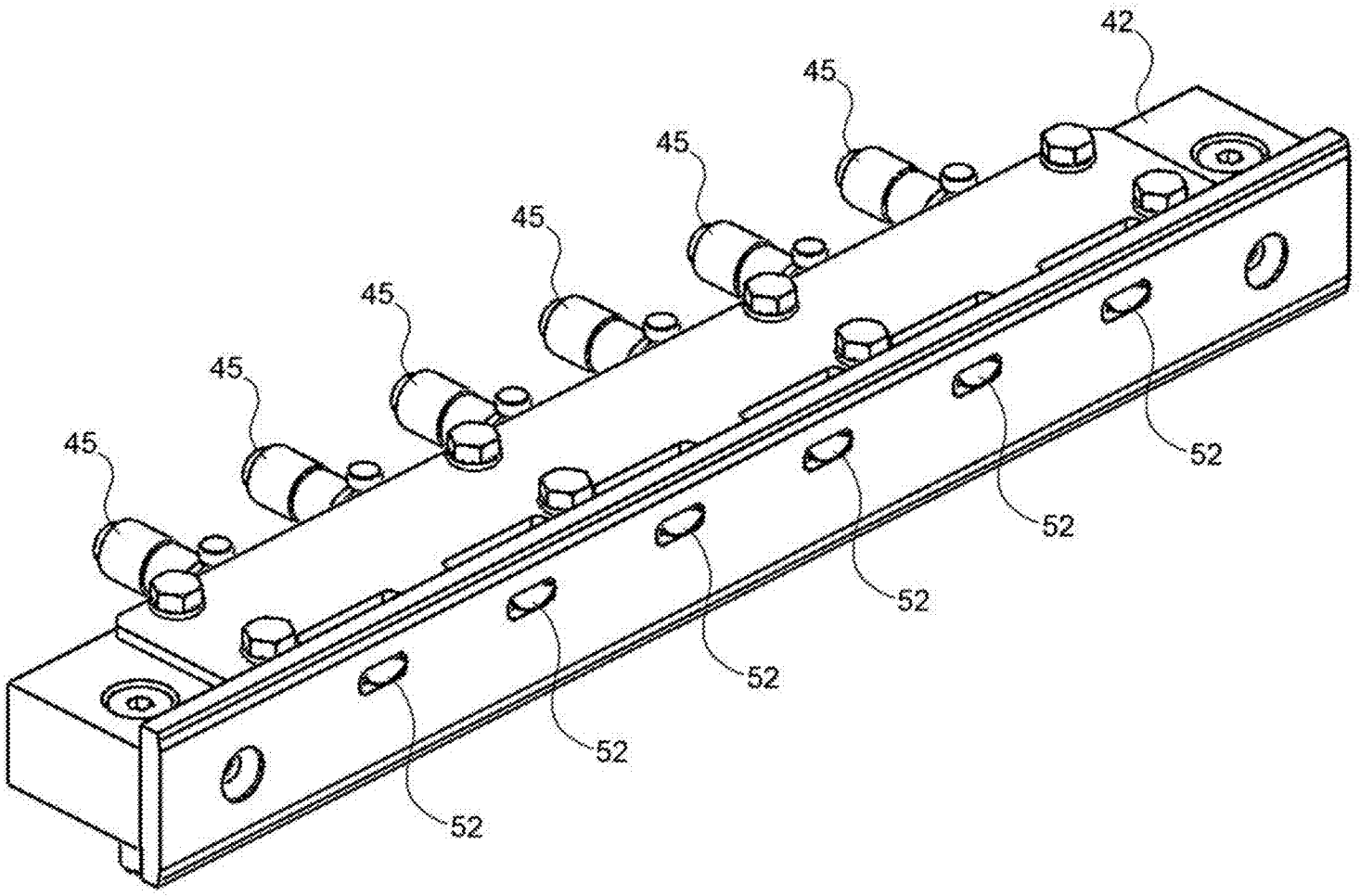
FIG. 20 is a perspective view of a plate attached to an incision tool for making a shaped incision, in a preferred embodiment.
Figure 21:
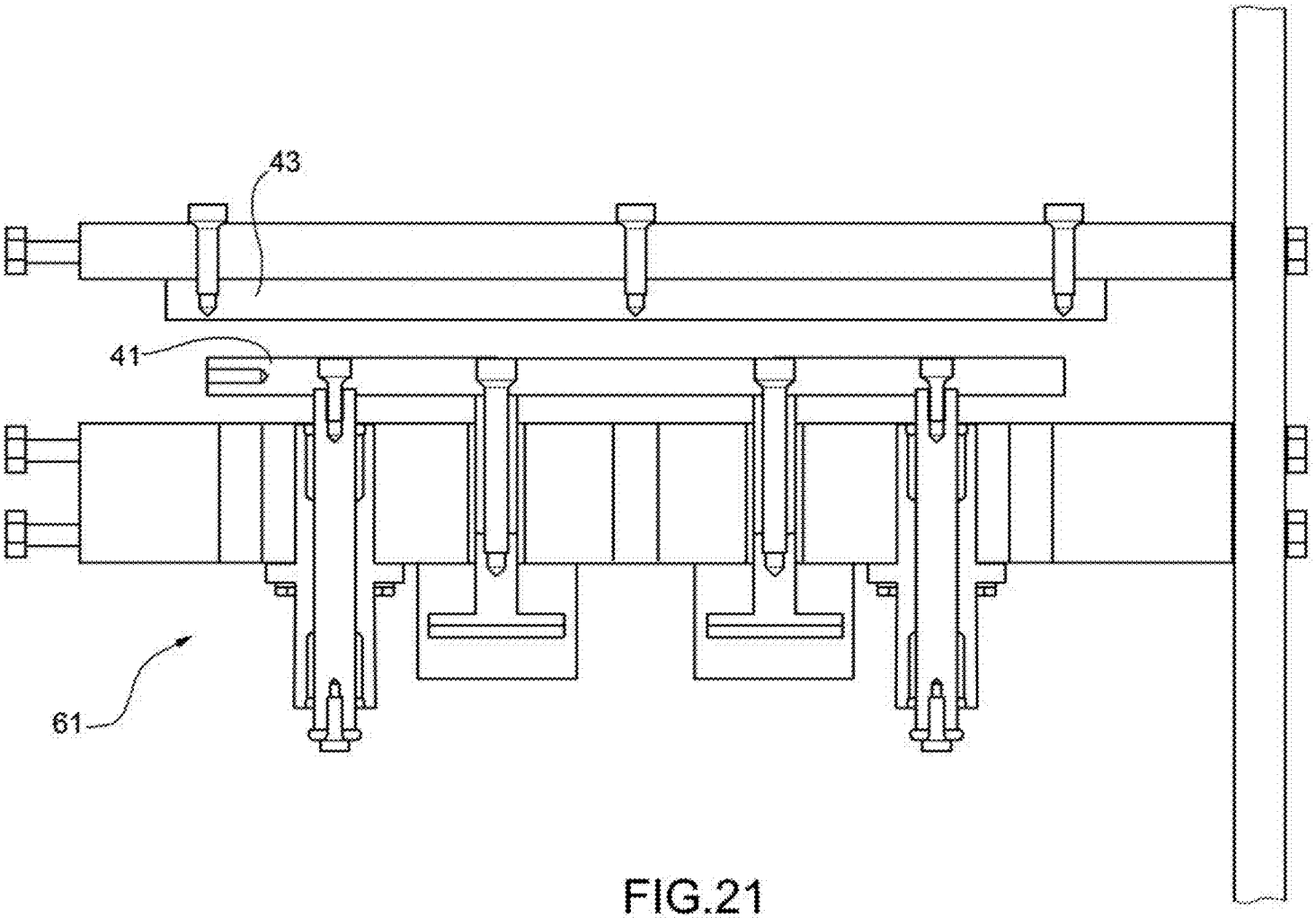
FIG. 21 shows a view from above of a first incision station of the device in FIG. 17.
Figure 22:
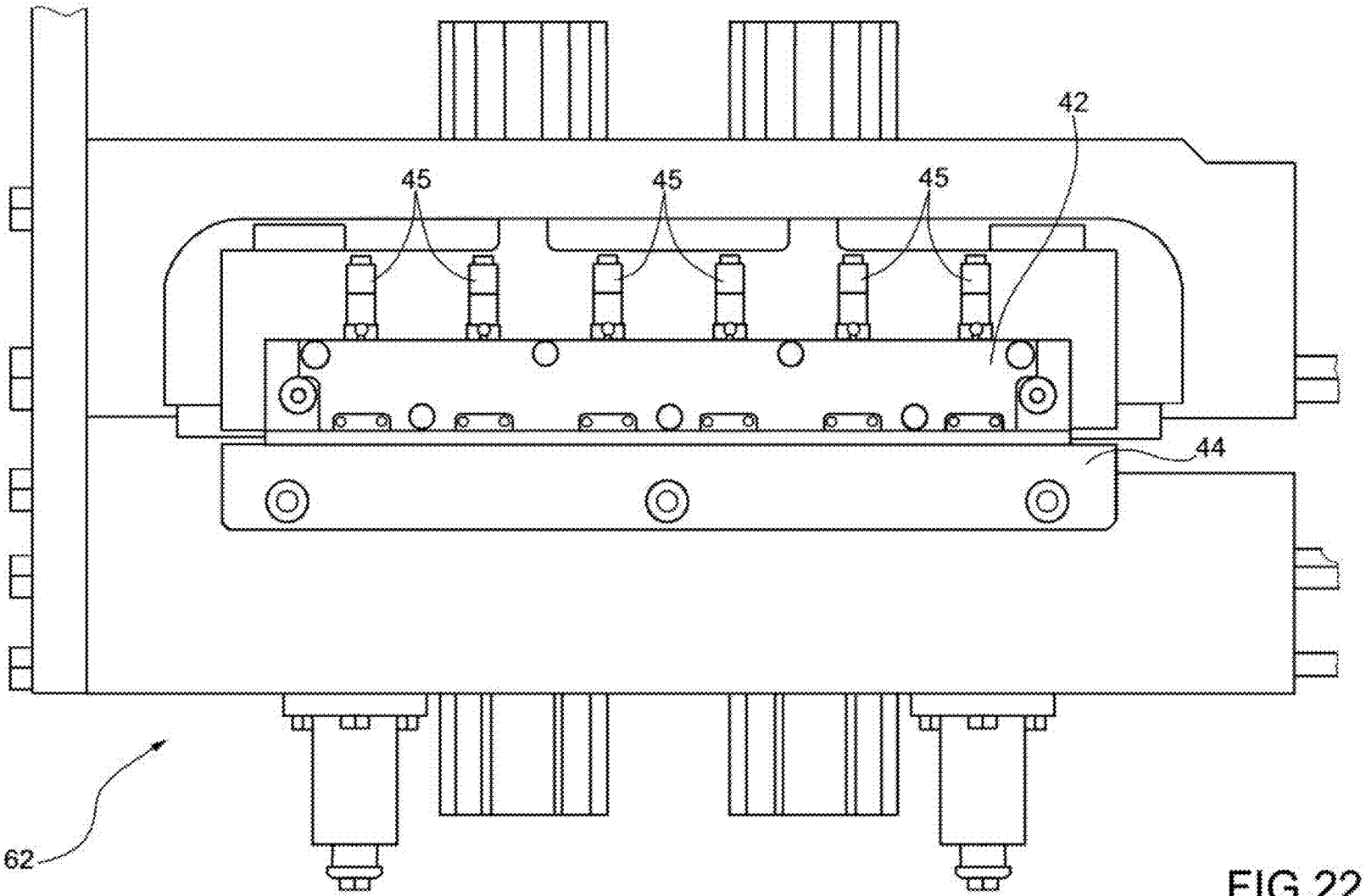
FIG. 22 shows a view from above of a second incision station of the device in FIG. 17.

FIG. 17 shows a preferred embodiment of a device 40 for making a weakening in a sheet 2 of semirigid plastic material. FIGS. 18-22 show details of the device 40.

According to the invention, the device 40 comprises at least one first plate 41 connected to at least a first incision tool 51 having at least one straight protrusion 53 for making a substantially straight first incision on a sheet of semirigid plastic material and at least one second plate 42 connected to at least a second incision tool 52 having at least one shaped protrusion for making a shaped incision on a sheet of semirigid plastic material.

Advantageously, the first plate 41 is attached to an incision tool 51 with two straight protrusions 53, 53' spaced apart from each other so as to simultaneously make two straight incisions spaced apart from each other. In the embodiment in FIG. 19, the incision tool 51 has a plurality of straight protrusions 53, 53' for making the incision or the incisions in a strip of semirigid plastic material from which more packages are subsequently made.

To make double-dose packages, the second plate 42 is attached to an incision tool with two straight protrusions spaced apart from each other.

Preferably, the straight protrusion 53, 53' of the first incision tool 51 has a constant length so as to make an incision with a constant depth in the sheet of semirigid plastic material 2.

The shaped protrusion of the second incision tool 52 has a constant length so as to make a shaped incision with a constant depth in the sheet of semirigid plastic material 2.

The device 40 is capable of being inserted into an apparatus for manufacturing a sealed single-dose break-open package 1, wherein a strip of semirigid plastic material preferably with a thickness of between approximately 200 microns and approximately 500 microns, in particular between 200 microns and 450 microns, is collected by a feeding unit (not shown).

Advantageously, the device 40 comprises a first incision station 61 for making the straight incision 6, 8 and a second incision station 62 for making the shaped incision 7.

The first incision station 61 (FIG. 21) comprises a plate 43 opposite to the first plate 41, wherein the first plate 41 is movable from a first position far from the opposite plate 43 to a predetermined position near to the opposite plate 43 so as to make a substantially straight incision 6, 8 in a strip of semirigid material interposed between the first plate 41 and the opposite plate 43, thus deforming the strip without cutting it.

The second incision station 62 (FIG. 22) comprises a plate 44 opposite to the second plate 42, wherein the second plate 42 is movable from a first position far from the opposite plate 44 to a predetermined position near to the opposite plate 44 so as to make a shaped incision 7 in a strip of semirigid material interposed between the second plate 42 and the opposite plate 44, thus deforming the strip without cutting it.

Advantageously, the second plate 42 has at least one micrometric measuring tool 45 positioned on the side opposite the opposite plate 43, which regulates the stroke of the incision tool 52 for making the shaped incision. The micrometric measuring tool 45 can be manual or motorised. Preferably, the stroke of the incision tool 52 is regulated relative to the second plate 42, and the second plate 42 is movable relative to the opposite plate 43, which is fixed.

In the embodiment shown in FIG. 17, the strip of semirigid material passes through the first incision station 61, where the lateral incisions 6, 8 are made on the surface of the strip that will form the outer surface 13 of the sheet of the package, namely, the one opposite the pocket 4 containing the product 5. The strip passes between the first plate 41 and the opposite plate 43 in a substantially vertical direction from low to high.

Using at least one linear actuator or motor, the first supporting plate 41 of the incision tool 51 is moved towards the opposite plate 43 in such a way that one end of the incision tool 51 moves the predetermined distance towards the opposite supporting plate 43 so as to make the deformation in the strip of semirigid material. In this way, the deformation is made with a constant depth.

The strip moves upwards in the second incision station 62, where the shaped central incision 7 is made on the surface opposite the semirigid sheet, namely the one that will form the inner surface 12 of the sheet and that faces the pocket 4 containing the product 5.

During the incision in the first station 61 and/or in the second station 62, the strip is parked by being rested on the opposite plate 43, 44.

Preferably, the second plate 42 has a plurality of incision tools 52 positioned in line, each attached to a respective manual or motorised micrometric measuring tool 45.

The unwinding of the strip is controlled by a motorised unwinder placed above the incision device and comprising two rollers 71, 72, which also have the function of keeping the strip tense so as to keep it in position during the machine standstill step in which the incisions occur.

Subsequently, the strip of semirigid plastic material in which the incisions have been made moves to a welding and filling station (not shown), in which the strip of semirigid plastic material is first joined to a strip of flexible plastic material, and filling then takes place as required.

According to the invention, one method for making a weakening in a sheet 2 of semirigid plastic material comprises the steps of making at least one substantially straight first incision 6 at a first edge 7 of the sheet 2; making at least one shaped incision 7 in a central portion 10 of the sheet 2 laterally and at a distance from the straight first incision 6, wherein the incisions 6, 7 are formed by the plastic deformation of the material of the sheet 2.

Preferably, according to the method at least one substantially straight second incision 8 is made at a second edge 11 of the first sheet 2, opposite to the first edge 9, laterally and at a distance from the shaped incision 7, wherein the second incision 8 is made by the plastic deformation of the material of the sheet 2.

The sealed single-dose package 1 described above has numerous advantages.

Firstly, the sealed single-dose package 1 is simpler and cheaper to manufacture than a similar known package 1 (for instance, of the type described in patent application WO2008038074A2), since the incisions 6, 7 and 8 have a constant depth and are therefore simpler to make even when operating at high manufacturing speeds.

Making a lateral incision at its edge enables a guided opening, which is then completed with the breakage of the sheet at the shaped central incision. Therefore, the product exits the central area rather than the lateral segment, which only serves to direct the folding of the package.

Moreover, the shaped central incision allows the user to control the exit of the product, which is dosed out correctly.

For dense fluid products, the rectangular or semi-elliptic configuration that separates from the rest of the sheet after opening allows the product to be spread over a surface.

For liquid products, the triangular configuration that is created after opening allows the product to be dosed out in drops. For powdered or granular products, the "zig-zag" configuration allows, first of all, a controlled exit of the product and, then, its complete distribution.

The invention claimed is:

1. A method for making a weakening in a sheet of semirigid plastic material, the method comprising the steps of:

making at least one substantially straight first incision at a first edge of the sheet;

making at least one shaped incision in a central portion of the sheet, laterally and at a distance from the at least one substantially straight first incision;

forming the incisions by plastic deformation of the material of the sheet;

making the incisions by moving a first plate connected to an incision tool having at least one protrusion from a first position far from an opposite plate to a predetermined position near to the opposite plate to produce the plastic deformation in the sheet placed between the first plate and the opposite plate.

2. The method for making the weakening according to claim 1, and further comprising making the at least one substantially straight first incision on a first surface of the sheet and making the at least one shaped incision on an opposite surface of the sheet.

3. The method for making a weakening according to claim 1, and further comprising making at least one substantially straight second incision at a second edge of the first sheet, opposite to the first edge, laterally and at a distance from the at least one shaped incision, wherein the at least one substantially straight second incision is made by plastic deformation of the material of the sheet.

4. The method for making a weakening according to claim 3, wherein the steps of making the at least one substantially straight first incision and the at least one substantially straight second incision are performed simultaneously.

5. The method for making a weakening according to claim 3, wherein the step of making the at least one substantially straight first incision and/or the step of making the at least one substantially straight second incision precedes the step of making the at least one shaped incision.

* * * * *